US008441191B2

(12) United States Patent
Protz et al.

(10) Patent No.: US 8,441,191 B2
(45) Date of Patent: May 14, 2013

(54) MULTI-CAVITY VACUUM ELECTRON BEAM DEVICE FOR OPERATING AT TERAHERTZ FREQUENCIES

(75) Inventors: Jonathan Michael Protz, Durham, NC (US); Marc Stephen Verdiel, Chicago, IL (US); David James Fields, Burke, VA (US)

(73) Assignee: Logos Technologies LLC, Fairfax, VA (US)

( * ) Notice: Subject to any disclaimer, the term of this patent is extended or adjusted under 35 U.S.C. 154(b) by 994 days.

(21) Appl. No.: 12/258,107

(22) Filed: Oct. 24, 2008

(65) Prior Publication Data

US 2009/0284126 A1 Nov. 19, 2009

Related U.S. Application Data

(60) Provisional application No. 61/053,577, filed on May 15, 2008.

(51) Int. Cl.
*H01J 25/10* (2006.01)

(52) U.S. Cl.
USPC ..... 315/5.39; 330/44

(58) Field of Classification Search ..... 315/5.39, 315/5.51, 5.41, 5.33, 5, 4; 331/83; 330/44, 330/45; 372/2
See application file for complete search history.

(56) References Cited

U.S. PATENT DOCUMENTS

| | | | | |
|---|---|---|---|---|
| 3,921,027 | A * | 11/1975 | Shelton et al. | 315/5.39 |
| 4,809,281 | A * | 2/1989 | Neil et al. | 372/2 |
| 5,680,011 | A * | 10/1997 | Makishima | 315/3 |
| 6,909,104 | B1 * | 6/2005 | Koops et al. | 250/493.1 |
| 8,076,853 | B1 * | 12/2011 | Caryotakis | 315/5 |
| 2007/0075907 | A1 * | 4/2007 | Gorrell et al. | 343/786 |

* cited by examiner

*Primary Examiner* — Benny Lee
(74) *Attorney, Agent, or Firm* — Arnold & Porter LLP

(57) ABSTRACT

The present invention relates to the formation of a vacuum electronics circuit by the fusion bonding of multiple substrate wafers, e.g., silicon, copper, or other suitable conductive material, each etched using DRIE, cut using EDM, or machined by other suitable means. Other aspects of the invention relate to the alignment of a cathode with tube by fusion bonding the cathode wafer to a tube built using the fabrication methods described herein. Yet other aspects involve the alignment of dies or wafers during the fabrication of a vacuum electronics device using the "lego" technique outlined herein. In yet other aspects, fabrication methods are described.

5 Claims, 22 Drawing Sheets

MULTI-CAVITY VACUUM ELECTRON BEAM DEVICE FOR OPERATING AT TERAHERTZ FREQUENCIES

RELATED APPLICATIONS

The present application claims the benefit of U.S. Provisional Application No. 61/053,577, filed May 15, 2008, the entire contents of which are herein incorporated by reference in its entirety.

FIELD OF THE INVENTION

The present invention relates generally to devices for generating electromagnetic radiation. More particularly, embodiments of the present invention include vacuum electronic devices and resonant cavities for use in such devices, and methods of micro-fabricating such devices and cavities.

BACKGROUND OF THE INVENTION

The Radio Frequency (RF) spectrum extends from low frequency radio, through radio, microwave, terahertz, infrared, visible, ultra-violet, and finally x-rays, and while the fundamental form of all the waves are the same, the mechanism for formation, and absorption of each varies. Radio and microwaves are created by macroscopic currents flowing or oscillating through a bulk material—as in a semiconductor, or and antenna. Much of the infra-red, Visible and Ultra-violet spectrum corresponds to energies attained through quantum electron shifts, and vibrational resonances of molecules. Very high energy and frequency radiation, such as X-rays, are produced by high energy particle interactions, such as bremstrahlung, or ionization of inner electrons. However there exists a gap between the maximum capabilities of current electronics, and the low end of the IR spectrum—this is the so-called terahertz gap, as it lies between ~300 GHz and 3 THz.

Terahertz (THz) radiation, also referred to as T-rays, Far-Infrared (FIR), and sub-millimeter radiation, is both interesting, and potentially very useful, as it has certain properties normally associated with both visible light and microwaves. For example, THz has the ability to pass through most materials with little attenuation. It has high attenuation in water, and is unable to penetrate metals. Yet, because of its lower wave length, it behaves more as a ray, and less as a wave, at small scales. The short wavelength 1 mm (300 Ghz) to 0.1 mm (3 THz) also allows for higher resolution than is attainable with microwave radiation. (This can be derived directly from the Rayleigh criterion.)

Groups have shown that THz can be used for tooth/bone density investigations, to detect cavities before they form [2]. The same technique, called Terahertz Time Domain Spectroscopy, has been used by Mittelman [3] to measure the position of raisins within a box of cereal, and density variation in chocolate bars. Various space agencies are also keenly interested in THz radiation, as much of the inter-stellar dust in the universe radiates in the THz region. The same technology is useful for study of the upper atmosphere. Many chemicals have unique absorption and transmission characteristics in the THz band—so a THz source would be immensely useful in chemical analysis and spectroscopy. A space mounted version of this would allow researchers to track pollutants in the upper atmosphere.

There is also interest in T-rays in the homeland security and intelligence community. T-rays can penetrate most materials easily, such as fabrics, plastics and cardboard. But unlike X-rays, they are non-ionizing radiation, so there are no obvious health concerns. This enables terahertz radiation to be used on biological specimens, and even people. Additionally, the spectroscopic data mentioned above could be use to chemically fingerprint explosives and other malicious agents. The resolution is so good that it is possible to read un-opened letters, based on the chemical signature of the ink used.

Despite the obvious potential of THz radiation, sources of T-rays remain either very expensive, very low power, or both. There have been several general approaches. The first involves non-linear reactive coupling of lower frequency signals. This takes advantage of available components operating in the 100 GHz range (which are scarce), and various materials with non-linear optical properties. High order multipliers are inefficient, so many THz sources use stacked low order frequency multipliers. This results in a signal with power of a few hundred μW.

High power THz radiation has also been produced through the use of a free electron laser (FEL), which operates by sending a relativistic electron through a sinusoidal magnetic field. From the electron's perspective, the magnetic field appears as a virtual photon, so can undergo Compton scattering. By controlling the frequency of the magnetic field (wavelength, and electron velocity) the frequency of the resulting radiation can be controlled, and tuned to THz frequencies. While this yields high power radiation, it requires millions of dollars of investment, and a large facility, of which only a handful exist in the world.

A similar technology is under research by Walsh at Dartmouth [6], and with Vermont Photonics. Walsh and his colleagues created a repetitive structure, capable of supporting a standing electromagnetic wave (often called a slow wave structure). By passing relativistic electrons across the surface of the slow wave structure, the electrons are effectively traveling faster than the speed of light. Superluminal electrons slow their velocity through an electromagnetic equivalent of a shockwave, called Cerenkov radiation. This is the same radiation that accounts for the blue glow associated with pool-type nuclear reactors. By controlling the electron velocity, and the slow wave structure, it is possible to tune the frequency of the Cerenkov radiation to the THz region. Vermont Photonics has achieved powers of up to 450 μW, using this technology [8].

Another technique that has been commercially successful because of its affiliation with THz Time Domain Spectroscopy involves down-conversion of optical wavelengths, through a photo-electric crystal. A dipole antenna is charged, and coupled by a photo-active element. A femto-second pulsed laser is then shone on the photoconductor, producing a THz pulse. Opto-electronic terahertz sources require a very well controlled laser source (Colliding pulse mode-locked, or $CO_2$). Efficiency continues to be very low, as a 120 W laser system can produce only a few mW of THz energy [2] [4]. Both these methods involve altering higher, or lower frequency radiation to produce THz frequencies. There exists another class of devices which operate by amplifying a signal. A band pass filter, and a feedback loop can allow these devices to operate as oscillators. Solid state signal sources are limited by material properties at high frequencies, and therefore have difficulties exceeding 100 GHz. However, the precursor to solid state electronics—vacuum tubes—can often offer higher performance than solid state devices, allowing them to operate at higher powers or higher frequencies.

Vacuum electronic technology originated with the first computers, radar, and generally the first RF systems. In the most basic form, a vacuum tube uses the coupling between electric forces, and kinematics of electrons to introduce gain to an RF signal.

While generally more expensive than solid state electronics, there are several applications in which vacuum electronics are regularly found. High power applications, such as TV or radio transmission towers and even satellite transmission often use Klystrons, Twystrons, Twystrodes, or other power vacuum tubes. Most particle accelerators use vacuum tubes to generate the accelerating fields. Many military applications also use vacuum electronics because they can operate in a wider temperature range, and are less sensitive to electronic noise (Hardened electronics).

The operating frequency of a vacuum device is dependent on the size and geometry of the resonating elements. In the case of a klystron, the resonators are simple cavity resonators. A traveling wave tube (TWT) employs a helical coil or a serpentine wave guide to support a wave (another slow wave structure). In each case, the resonant frequency is governed by the geometry, and is of a scale on the order of the wavelength. This makes conventional power vacuum electronics effective for frequencies ranging from about 5 MHz up to 25 GHz.

Several attempts are currently under way to produce high frequency vacuum tubes by using a variety of microfabrication techniques. Much of the focus is on providing power for a next generation linear accelerator—which necessitates a power source of several mega-watts operating in the W-band (about 95 GHz).

The Stanford Linear Accelerator Center (SLAC) developed a 94 GHz device, called a Klystrino, using a microfabrication technique known as LIGA (from the German acronym for lithography, electroplating and micro-molding) [7]. Because of its application, it was designed to produce 400 kW peak power, and 4 kW average power, through and assembly of 4 individual beam tunnels [9]. The device was successfully fabricated, and assembled, and the cavity properties were measured while beam loaded. It required an overall precision of ~5 μm, which was achieved with LIGA for the cavities, and wire EDM for the drift tube. It ultimately failed under test due to a magnetic misalignment. [10] LIGA has also been used for fabrication of resonant cavities for accelerator purposes. J. J. Song et al. [11] made a sample accelerator cavity, 7 cm long with an operating frequency of 94 GHz, as well as designs for a 1-m long structure with an operating frequency of 108 GHz. The individual cavities are on the order of 1 mm, but the tolerance is <0.2%, to attain the required Q. LIGA seems to have a lot of potential; however it is limited in its use, because it requires a hard x-ray source for exposure, such as a synchrotron, and long exposure times (4-8 hours). As such, waiting lists for LIGA exposure are months or even years long.

The Jet Propulsion Lab has also fielded a project, led by Manohara [12] to produce a reflex klystron that operates at 1.2 THz, and produces 3 mW of power with an efficiency of 0.2%. Manohora and his colleagues propose etching a gridded cavity using deep reactive ion etching (DRIE), and silicon bonding. Several proposals have been produced, and various components have been fabricated, however no functional device has been produced. The THz reflex klystron is designed to operate with a large current (3 mA), which requires a cathode current density of 100 to 1000 A/cm2. While Manohora and his colleagues at the Jet Propulsion Lab propose using a carbon nanotube field emission array (FEA), they have not succeeded in creating such a device.

A private research company, Calabazas Creek Research Inc. has designed a backwards wave oscillator (BWO) using a variety of microfabrication techniques, including electric discharge machining (EDM) and LIGA. The device operates from 500-600 GHz, and is expected to produce 6-8 mW of power. Backward wave oscillators offer more tunability than klystrons, but give up efficiency. The design includes a reservoir type thermionic cathode, and a depressed collector, both of which act to increase the efficiency of the device. The structure has been fabricated using LIGA, however only 8% of the fabricated circuits were in usable condition. No results from tests were found. [13]

Similar projects are in progress at Northrop Grumman, and Genvac. The Northrop Grumman project [14] uses a serpentine waveguide to act as a slow-wave structure, like a TWT. It has been successfully fabricated, and was able to produce a few milliwatts of power with an efficiency of 0.6% at 650 GHz. The Genvac approach [15] also uses slow wave structures, however it employs a fabrication process using chemical vapor deposition (CVD) diamond for structural elements. The resonant structure has been fabricated, but successful operation has not yet been demonstrated.

As such, there still exists a need in the art for improved vacuum compatible THz frequency electromagnetic wave sources, methods of micro-fabricating such devices and resonant cavities suitable therefore.

SUMMARY OF THE INVENTION

In part, certain aspects of the present invention relate to the formation of a vacuum electronics circuit by the fusion bonding of multiple substrate wafers, e.g., silicon, copper, or other suitable conductive material, each etched using DRIE, cut using EDM, or machined by other suitable means. Other aspects of the invention relate to the alignment of a cathode with a drift tube by fusion bonding the cathode wafer to a tube built using the fabrication methods described herein. Yet other aspects involve the alignment of dies or wafers during the fabrication of a vacuum electronics device using the self-aligning technique outlined herein.

In yet other aspects, fabrication methods are described, including the simultaneous etching of the dies for each layer in the stack all on a single (or a few) wafers, then dicing the wafers and assembling the stack at the die level. The methods include the use of nested mask etch to form the cavity; the integration of a collector formed from the fusion bonding of multiple copper layers, or layers of another material, with the tube by fusion bonding or anodic bonding the collector to the tube; and the coupling of multiple parallel tubes together to form a multi-beam klystron or other vacuum electronic device.

Further, in certain embodiments, the invention provides for the integration of a pseudo-spark electron source with the tube to avoid the need to magnetically confine the electron beam. In other embodiments, the invention provides for the implementation of a periodic permanent magnet beam confinement system by dropping in permanent magnets into hollows etched around the drift tube using a process identical to the cavity etch process. In yet other embodiments, the invention provides for the coupling of power into or out of the cavities of the vacuum electronics device by way of waveguides formed during the same etch steps as the cavities.

BRIEF DESCRIPTION OF THE DRAWINGS

The following drawings illustrate exemplary embodiments for carrying out the invention. Like reference numerals refer to like parts in different views or embodiments of the present invention in the drawings and may not be described in detail in every drawing in which they appear.

DETAILED DESCRIPTION OF THE INVENTION

Figure 1:
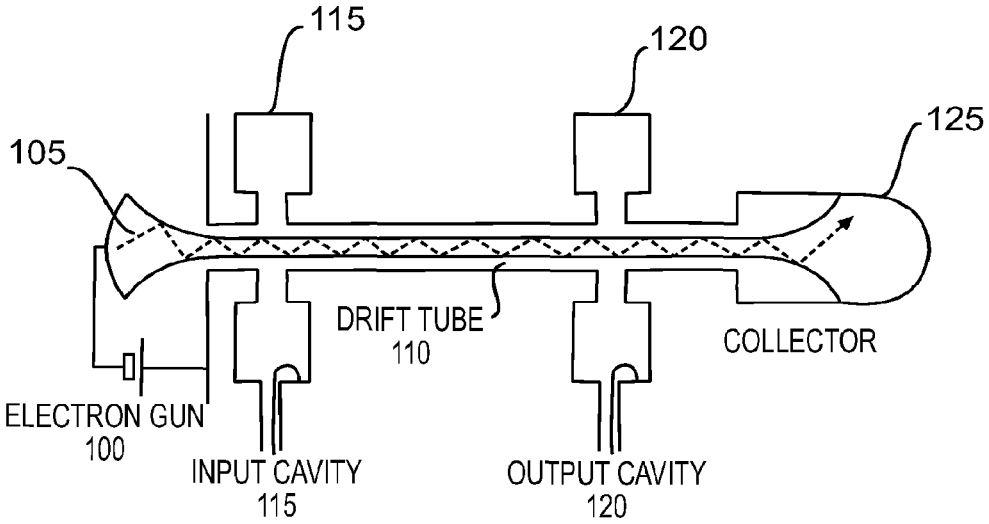
FIGS. 1 and 2 illustrate exemplary klystron devices.

Increasing the operating frequency of Vacuum Electronic Devices (VEDs) requires smaller, more precisely machined resonant structures. The present invention provides VEDs and resonant cavities for use therewith, as well as fabrication methods for such devices and cavities. In certain aspects, the disclosed devices, cavities and methods can achieve THz frequencies.

A first aspect of the invention provides a method for fabricating resonant cavities. The method generally comprises: (1) etching high aspect ratio cavities in wafers; (2) electroplating metal on the surface of the cavities; and (3) aligning and bonding metalized cavities of wafers to form resonant cavities.

In certain embodiments, the wafer may be a silicon or quartz substrate. The metal may be copper or other suitable conducting material. As described in further detail herein, deep reactive ion etching may be used to etch the high aspect ratio cavities into the wafers.

In yet another embodiment, the metalized cavities may be aligned for fusion using a vernier offset approach or a precision alignment using integrated registration structures in the material. Such a registration type alignment is described further herein with reference to a self-aligning, interlocking approach.

Another aspect of the invention related to a method for fabricating a vacuum electron device. The method generally comprises: (1) providing resonant cavities, e.g., such as those prepared according to the methods described herein; (2) aligning the resonant cavities with a wafer stack having a conducting drift tube; (3) bonding the resonant cavities to the wafer stack having the drift tube; and (4) aligning and bonding an electron source to the cavity/tube wafer stack to form a vacuum electron device.

In certain embodiments, the drift tube may be fabricated in the wafer stack via DRIE, bore drilling, electrical discharge machining (EDM), laser ablation or electroforming. The electron source may be a field emitter array (FEA), a thermionic cathode, a cusp gun or a pseudospark gap. In yet other embodiments, a collector may additionally be bonded to the tube of the vacuum electron device, e.g., through fusion or anodic bonding.

In certain embodiments, the inputs and/or outputs of the device may be fabricated simultaneously with the resonant cavities. Alternatively, the parts or layers (including inputs/outputs) of the final device may be fabricated in parallel, using similar fabrication steps and processes.

In a particular embodiment, the electron source is aligned and bonded to the device in such a manner that the beam of electrons emitted from the electron source propagates primarily in a direction normal to the plane of the wafer or substrate that contains the electron source.

Vacuum Electronic Devices:

A first aspect of the invention relates to the design and fabrication of vacuum electronic devices and of micro-scale (e.g., 400 μm largest dimension, <1 μm tolerance) resonant cavities for use in vacuum electronic devices. Such devices include, but are not limited to, TWTs, BWOs, Extended Interaction Klystrons (EIKs), etc. In one embodiment, an exemplary device is a klystron, such as a micro-klystron, which may be a high frequency (THz) oscillator, or amplifier, depending on the setup of the inputs.

Figure 2:
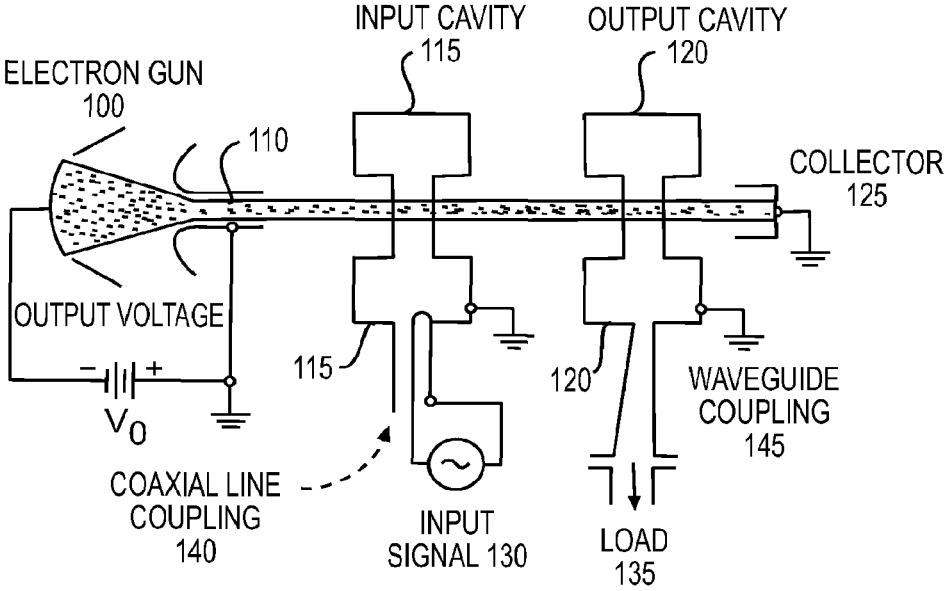

FIGS. 1 and 2 illustrate exemplary designs of klystrons, as well as FIGS. 36*a*-36*f*, which illustrate the basic fabrication, geometry and output features of a MEMS Klystron. (It will be understood by one having ordinary skill in the art that these diagrams present a two-dimensional cross-section of the klystron, and that the various components, such as the cavities and drift tube are actually cylindrical.) As shown in FIGS. 1 and 2, an electron gun (sometimes also referred to in the art as an "electron source") 100 (having output voltage $V_g$ as shown in FIG. 2) may transmit an electron beam 105 (FIG. 1) through a drift tube 110 and a series of resonant cavities 115, 120. The first resonant cavity, an "input cavity" 115, is excited by an external source, e.g. input source 130 (FIG. 2), imparting an RF (radio frequency) signal to the beam 105. As the beam 105 drifts down the "drift tube" 110, the signal power of the beam 105 increases, reaching a maximum at the second, or "output cavity" 120, where the energy is used to drive an output load 135 (FIG. 2), resulting in an amplifier. If a portion of the output power is used to drive the input, the device will operate as an oscillator, resulting in a source. Klystrons also may have one or more waveguides or coaxial couplings which may be used to couple microwave energy into and out of the device; for example, as shown on FIG. 2, the input cavity 115 may be coupled to a coaxial line 140 and the output cavity 120 may be coupled to a waveguide 145. Any unused energy remaining in the electron beam 105 is dissipated into heat by a collector 125, which is responsible for cooling the klystron. For example, a suitable collector 125 may be a tube-fin heat exchanger or an IMV cross-flow micro heat exchanger with 20 kW of heat transfer and 1 cc volume.

Cavity Design:

Another aspect of the invention relates to the resonant cavities (e.g., the input and output cavities 115, 120) of the VEDs. The resonant cavities 115, 120 are generally cylindrical voids, located coaxially with the drift tube 110 of the VED.

Figure 3A:
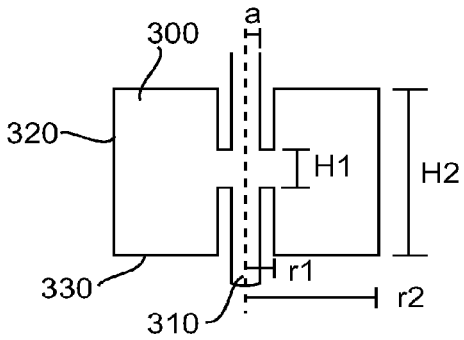
FIGS. 3A-3B illustrate an exemplary resonant cavity design.
Figure 3B:
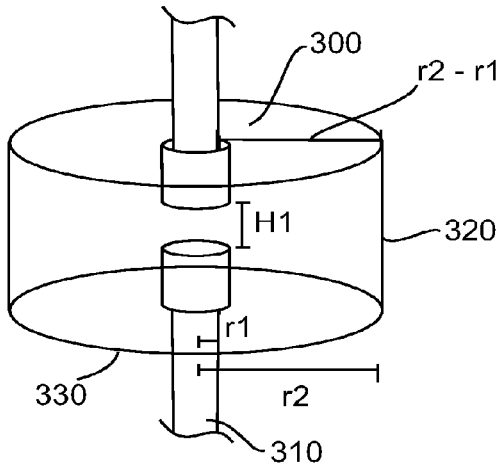

An illustrative cavity 300, coaxial with a drift tube 310, is shown in FIGS. 3A-3B. FIG. 3A shows a two-dimensional cross-section of the drift tube 310 and the resonant cavity 300. FIG. 3B shows a corresponding three-dimensional representation of the drift tube 310 and resonant cavity 300. As shown in more detail on FIG. 3A, the drift tube 310 has radius a. As shown on FIGS. 3A and 3B, the resonant cavity 300 has a narrower, capacitive center section, shown as having height H1 and extending a radius of r1 from the central axis (i.e., the axis with which the drift tube 310 and cavity 300 are coaxial), and a larger inductive outer section, shown as having height H2 and extending radius r2, and, as shown on FIG. 3B, radius r2−r1.

Generally due to fabrication techniques, as shown in FIGS. 3A-3B, the walls 320 of the cavity 300 are generally vertical, the bases 330 of the cavity are generally flat, and the corners are at approx. 90° angles. Exemplary dimensions are provided below. However, the invention is not so limited, and the values may vary as recognized by those skilled in the art and described herein.

| Dimension | Value |
|---|---|
| H1 | 100 um |
| H2 | 430 um |
| r1 | 55 um |
| r2 | 400 um |
| a | 35 um |
| F0 | 200 GHz |
| Q | 1060 |
| R/Q | 326 |

The operating frequency of the device is determined by the dimensions of the resonant cavities, and in part by the length and diameter of the drift tube. To operate at terahertz ($10^{12}$ Hz), the maximum dimension of the cavities is on the order of $\lambda/2$, where $\lambda$ is the wavelength. At 1 THz, this corresponds to about 150 μm. However, the cavities are very sensitive to changes in their geometry—so that the tolerances must be less than 1 μm. This is below the tolerances of conventional manufacturing processes, and is near the limits of current technology for bulk micro-fabrication.

The innovation described here proposes a method of fabricating cavities 115, 120 with the desired dimensions and tolerances, and for assembling those cavities along with an appropriate drift tube 110, and electron source 100.

In one embodiment, the electron source 100 is proposed to be a field emitter array (FEA), however other electron sources are possible, including but not limited to thermionic cathodes, cusp guns, or pseudo-spark gaps. The advantage of using a high density current source like an FEA or pseudo-spark, is that the beam does not require compression or focusing, making beam alignment and containment much simpler.

Fabrication:

Yet another aspect of the invention is related to fabrication techniques for the resonant cavities described herein. Conventional micromachining techniques may generally be used, as understood by those of skill in the art. While many viable materials exist, copper, silicon, quartz, silicon coated with copper, quartz coated with copper, or other suitable conducting materials are preferred. The fabrication process utilizes a number of established techniques, including deep reactive ion etching (DRIE), fusion bonding, sputtering, and electroplating.

FIGS. 37*a*-37*d* are two-dimensional, cross-sectional drawings showing how the fabrication process works. (Each of the steps shown on these figures are described in further detail below.) First, as shown on FIGS. 37*a* and 37*b*, two wafers 3700*a*, 3700*b* are fabricated such that each wafer has half of the cavity (shown as 3710*a* on wafer 3700*a*, and as 3710*b* on wafer 3700*b*, all as shown on FIG. 37*b*) and half of a drift tube (shown as 3720*a* and 3720*b* on FIG. 37*b*). As shown on FIG. 37*c*, the cavity-halves 3710*a*, 3710*b* are then metalized using a sputtered seed layer 3730*a*, 3730*b*, followed by electrodeposition of copper 3740*a*, 3740*b*. Then, as shown on FIG. 37*d*, the two wafers 3700*a*, 3700*b* may be stacked and aligned to create a full cavity (e.g., 115) and a drift tube 110, and fusion bonded to form the overall device.

In a first aspect, the fabrication methods of the invention will preferably utilize DRIE to create the high aspect ratio cavity-halves. DRIE is a process that alternates isotropic dry etching with passivation to achieve very high aspect ratio etches.

FIGS. 32*a*-32*e* illustrate an exemplary DRIE process in accordance with an embodiment of the invention.

Figure 32A:
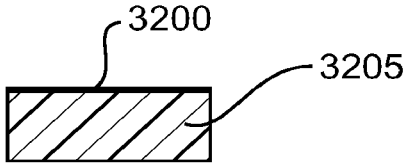
FIGS. 32*a*-32*e* illustrate an exemplary deep reactive ion etch process.
Figure 32B:
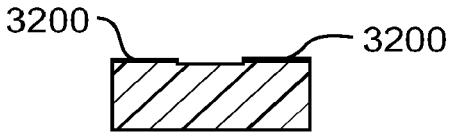
Figure 32C:
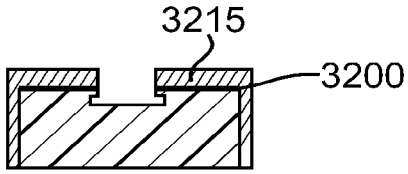
Figure 32D:
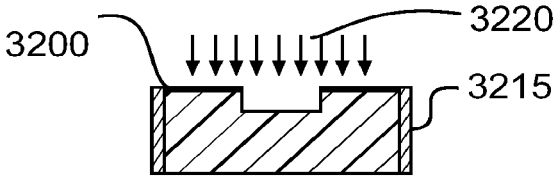
Figure 32E:
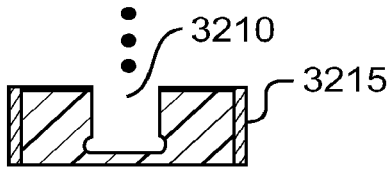

With reference to FIG. 32*a*, a protective layer 3200 is grown on the substrate 3205, typically SiO2 on Si. A pattern is then etched on the mask 3200 (FIG. 32*b*). This can be done using various lithographic techniques. The wafer 3205 is then exposed to an isotropic dry etchant for a short period of time, resulting in a shallow etch 3210 (FIG. 32*e*). A passivation layer 3215, such as Teflon, is applied over the surface of the protective layer 3200 (FIG. 32*c*). The passivating layer 3215 is chemomechanically etched, using ion bombardment 3220, so that only the sidewalls remain protected (FIG. 32*d*). The wafer is again exposed to the dry etchant. The cycle is repeated until the desired etch 3210 depth is attained (FIG. 32*e*).

Because of the combination of isotropic etch and passivation, DRIE often produces a scalloped effect at the beginning of an etch. However improvements in DRIE capabilities have been able to reduce surface roughness to 0.03 μm, which is significantly below the skin depth of THZ, e.g., 200 GHz waves, in copper, and much thinner than the proposed copper layer. In plane, the walls of the etch can be maintained vertical to within 0.4 μm for etches exceeding 300 μm in depth. By using the DRIE process in conjunction with buried etch-stop layers, such as buried oxide layers, the out of plane etch control can be equally precise, and the final etch face has very low surface roughness.

In addition to fabricating the cavities 115, 120, input/output waveguides and coupling structures must also be fabricated in this step. Because of the small tolerances allowable on the cavities, the waveguide coupling structure (generally an inductive loop, or a coupling port). Waveguides may either run parallel to the wafer surface, to a waveguide port at the side, or may turn and travel through the stack of wafers to a port on the top or bottom surface of the wafer stack.

Figure 35:
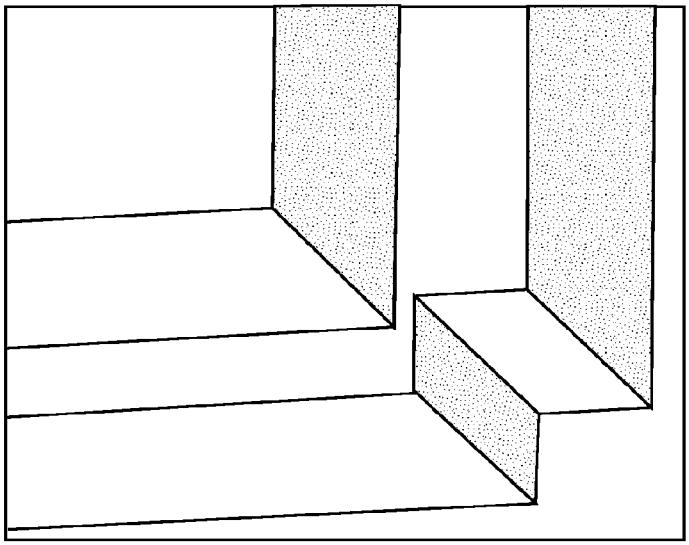
FIG. 35 illustrates a transition from a waveguide via a step.

To couple to a conventional rectangular waveguide, the input/output waveguide may need to go through a series of discrete steps, adjusting either height or width. Gradual, discrete steps can be appropriately designed to minimize loss and reflection. A similar step can be used to improve transmission around the necessarily square corner to transition from a horizontal to vertical waveguide. FIG. 35 (transition from 1092×362 um waveguide to WR4, via a 90° bend with step) shows an example of such a step.

In another embodiment according to the current disclosure, wafers comprising cavity-halves and drift tube halves are fabricated having 3 distinct etch depths, as opposed to a simple DRIE etch, in which all etches proceed at the same rate. To attain variation out of plane, this micro klystron fabrication technique uses a triple-nested mask. Out of plane etch depth control is implemented through the use of etch stop layers. An exemplary fabrication method, wherein each wafer has 3 distinct etch depths, is shown in FIG. 33. In this embodiment, the fabrication method of the invention may use a type of wafer known as a Silicon on Insulator (SOI) or buried oxide wafer. The buried oxide layers offer excellent control of the out of plane etch, and are suited to preferably obtain the desired tolerances.

Figure 33A:
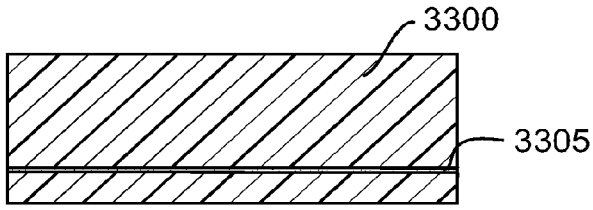
FIGS. 33*a*-33*m* illustrate an exemplary etch step for a fabrication process of the invention.
Figure 33B:
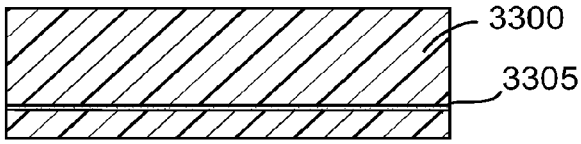
Figure 33C:
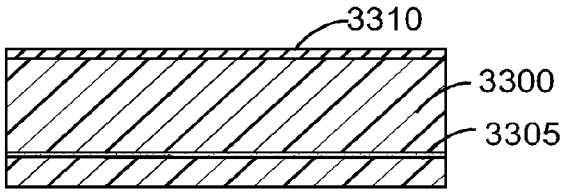

With reference to FIG. 33, the initial SOI wafer 3300 is shown in FIG. 33*a*. By way of example, the illustrated buried oxide layer 3305 may be approximately 215 μm below the surface of the wafer 3300. Moving to FIG. 33*b*, the wafer

Figure 33D:
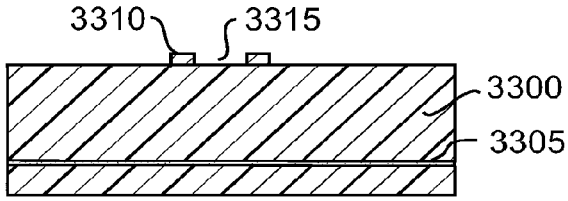
Figure 33E:
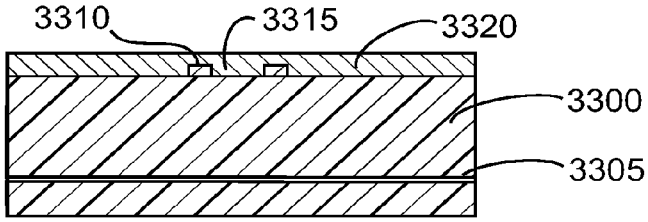
Figure 33F:
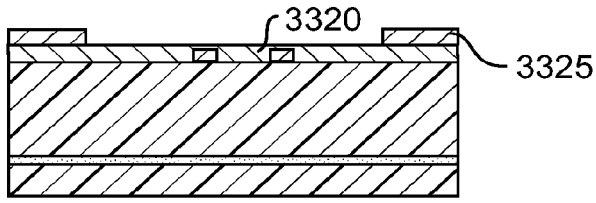
Figure 33G:
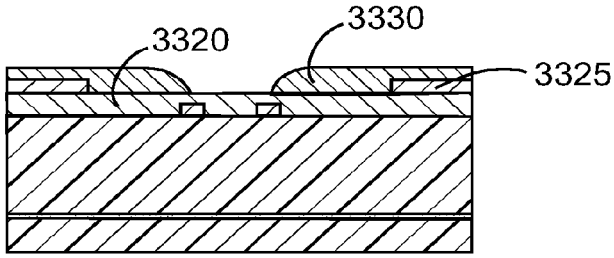
Figure 33H:
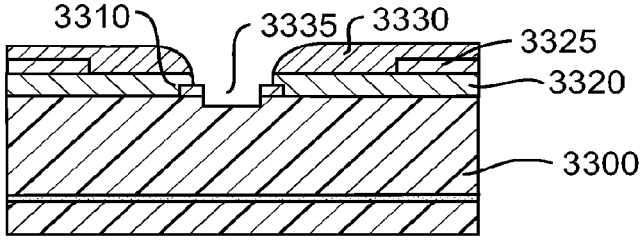
Figure 33I:
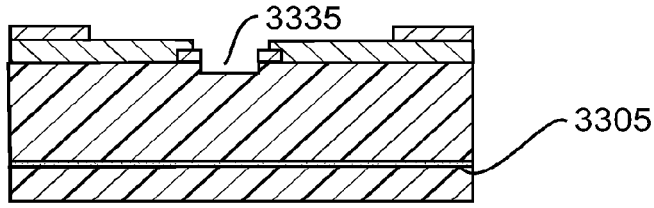

3300 may be prepared using chemical mechanical polishing (CMP), to ensure that the buried oxide 3305 is at the desired depth. A nitride layer 3310 may then be grown over the silicon 3300 (FIG. 33*c*) and patterned to be the surface of the capacitive gap 3315 in nitride layer 3310 (FIG. 33*d*). Continuing, amorphous silicon 3320 may be grown over top of the nitride mask 3310 (FIG. 33*e*). A silicon dioxide layer 3325 may then be grown on the silicon 3320, patterned, and etched to form a second mask (FIG. 33*f*). Next, a photoresist layer 3330 may be spun on, and patterned (FIG. 33*g*). Another etch for the drift tube 3335 may progress until some of the nitride mask 3310 is exposed (FIG. 33*h*).

Figure 33J:
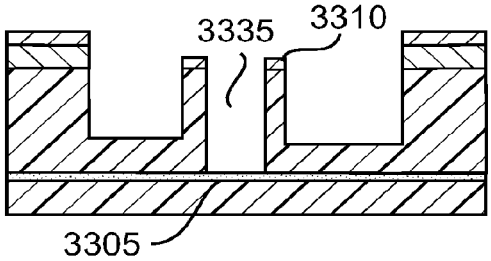
Figure 33K:
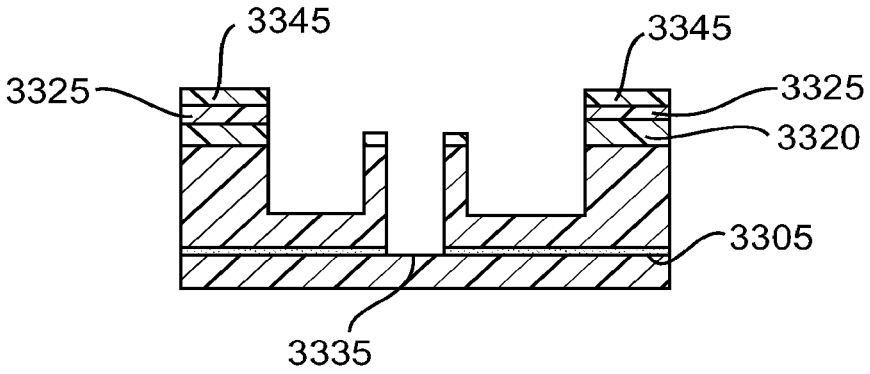
Figure 33L:
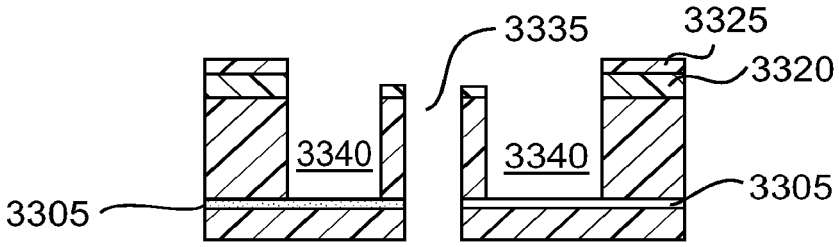
Figure 33M:
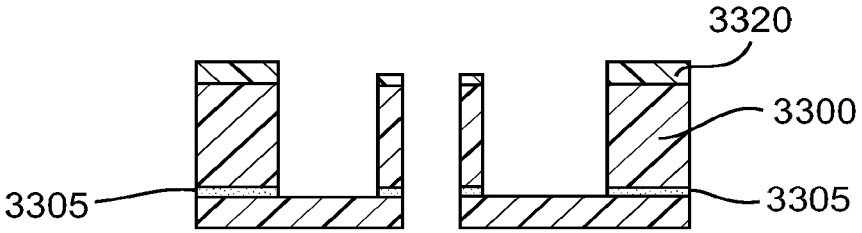

Moving on, the photoresist mask 3330 may be stripped off (FIG. 33*i*), and the etch 3335 may continue until the oxide layer 3305 is exposed at the bottom of the drift tube (FIG. 33*j*). The oxide mask 3325 may then be protected with photoresist 3345, and the oxide layer 3305 at the bottom of the drift tube 3335 etched (FIG. 33*k*). The photoresist 3345 can then be stripped, and the DRIE can continue until the inductive cavities 3340 reach the oxide layer 3305 (FIG. 331). Then, the remaining oxide layers 3325 (and optionally the nitride layer 3310) may be etched off, and the wafer 3300 prepared for electroplating (FIG. 33*m*).

An electrically resonant cavity requires a high conductivity surface, to reflect the EM waves with as little attenuation as possible. Thus, following the step of fabricating the cavity-halves—regardless of how they are fabricated, i.e., in accordance with the processes shown in FIGS. 38*a*-32*e*, FIGS. 33*a*-33*m*, or some other fabrication process—the cavity surfaces are plated with a metallic layer. Preferred choices include gold and copper, for their electrical conductivity, and their ease of application. Both diffuse easily into silicon, so a boundary layer of Tantalum can be used to prevent the creation of a eutectic mix at the boundary, with unpredictable electrical properties. Copper has been studied quite extensively for its fusion bonding properties, to be used in interconnect technology for the semi-conductor industry. While it is more reactive than gold in an oxygen atmosphere, forming a protective oxide, it is more conductive, and well suited to operation in a vacuum environment, such as the interior of a klystron. If during fabrication, the chemical activity of copper becomes an issue, gold may be used as a second option. However, any suitable conducting material may be used.

As mentioned before, the skin depth in Copper at 200 GHz is ~150 nm. Because field intensity decreases exponentially, it is desirable to have the conductive layer extend for several multiples of the skin depth. Copper can be sputtered to depths of several hundred nm, however, because of the convoluted shape of the cavity to be sputtered, it is predicted that more even coverage will be obtained using electrodeposition of copper over a sputtered seed layer. The depth of deposition can be controlled by controlling the current of the cell. The exposed face of the conducting material may then be polished to be extremely smooth, using, e.g., CMP.

Following the step of plating the cavity-halves with metal, the two halves of the cavity are united and ultimately the entire stack of wafers are formed into a single device. When aligned, wafer faces are placed in contact with each other, and subjected to elevated temperatures (450° C.) and pressures (4000 mBar) followed by a cooling cycle and nitrogen annealing. This creates a very strong bond, with fracture strength near that of the raw copper.

Conventional mask aligners may be used to produce alignment with an repeatable error of, e.g., 2 μm, which is quite large compared to the tolerances of the device. If desired, one method to achieve better alignment using traditional mask alignment is to implement an intentional offset. As with a Vernier scale, if one set of masks has slightly different spacing than the other, good alignment can be guaranteed at one position, at the expense of a low yield. If 5×5 arrays are used, each with an offset of 0.5 μm, than it is ensured that one device will have an alignment error of 0.35 μm (0.25 μm*√2). However it also guarantees that 24 devices will have error greater than this, resulting in a 4% yield. If 3 wafers are stacked, and the necessary precision remains, the yield drops to 0.16%, and continues to diminish rapidly as the number of bonded wafers increases.

Figure 34:
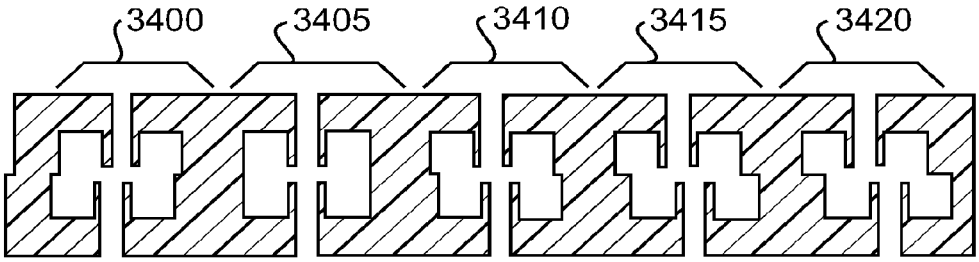
FIG. 34 illustrates an exemplary vernier offset approach of an embodiment of the invention.

FIG. 34 illustrates a vernier offset approach for aligning cavity-halves to create full cavities (e.g., 115). Cavity-halves on the bottom wafer are spaced slightly further apart than cavity-halves on the top wafer. When bonded, one cavity aligns very well so long as the overall wafer alignment is within a much larger tolerance. For example, as shown on FIG. 34, the second cavity 3405 aligns very well, while the other cavities 3400, 3410, 3415, and 3420 do not.

In an alternative embodiment, a self-aligning technique may also be used which self-aligns structures to achieve alignments better than 200 nm. Like a self aligning LEGO® block, a series of peaks fit into corresponding sockets to align the masks. While work has been done with self-aligning structures before, normally the presence of the peaks precludes proper treatment for fusion bonding, as the surface cannot be polished adequately. This self-aligning technique uses pre-stressed cantilevers to actuate the aligning structures, allowing self-aligning, and fusion bonding. Self-aligning structures have been implemented successfully at the die level. Such self aligning of structures can dramatically improve the yield, during fabrication of cavities, particularly in the cases of multi-wafer stacks. However there is a cost associated with the real estate of the aligning structures themselves. As much as 25% of the wafer is consumed by the aligning structures themselves; however, this can still provide better performance and better accuracy than using a vernier offset.

Figure 28:
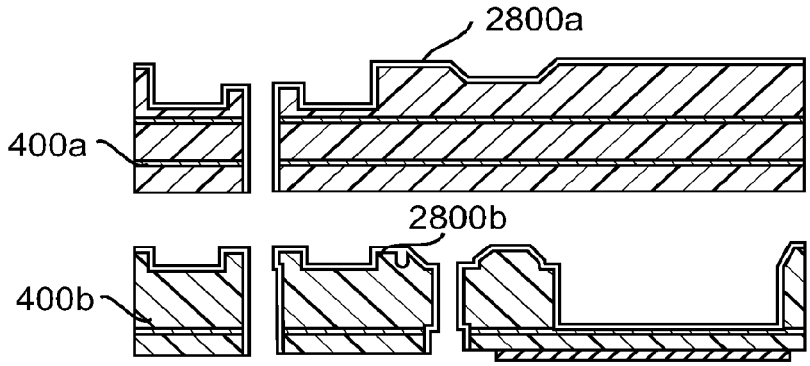
Figure 29:
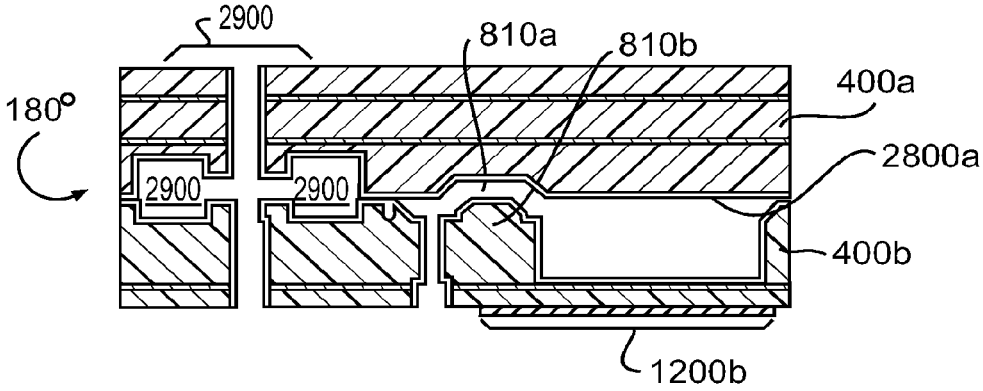

FIGS. 4, 5, 6, 7, 8, 9, 10, 11, 12, 13, 14, 15, 16, 17, 18, 19, 20, 21, 22, 23, 24, 25, 26, 27, 28, and 29 illustrate one exemplary embodiment for the fabrication of self-aligning cavity structures, showing the fabrication of each cavity-half (i.e., as shown in FIGS. 4, 5, 6, 7, 8, 9, 10, 11, 12, 13, 14, 15, 16, 17, 18, 19, 20, 21, 22, 23, 24, 25, 26, and 27), the metalization of the cavity-halves (i.e., as shown in FIG. 28), and the alignment and fusion of the cavity-halves to create full cavities (e.g., 115) (i.e., as shown in FIG. 29).

Figure 4:
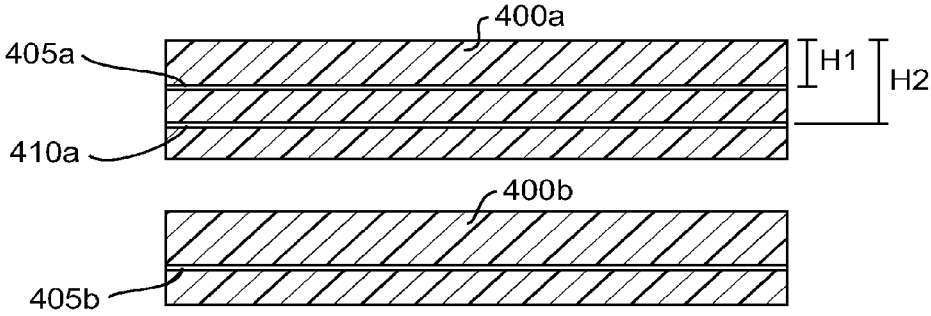
FIGS. 4, 5, 6, 7, 8, 9, 10, 11, 12, 13, 14, 15, 16, 17, 18, 19, 20, 21, 22, 23, 24, 25, 26, 27, 28, and 29 illustrate an exemplary fabrication method.

In this particular exemplary embodiment, as shown in FIG. 4, the raw wafers that may be utilized in the process are two SOI wafers 400*a* and 400*b*, one 400*a* with two buried oxide layers 405*a*, 410*a*, and one 400*b* with a single buried oxide layer 405*b*. The depth of the buried layers in each wafer 400*a*, 400*b* may be closely controlled using CMP. The depth of the top layer 405*a* (H1) on the two layer wafer 400*a* determines the length of the interaction gap (i.e, H1 as shown on FIGS. 3A and 3B), while the depth of the second layer 410*a* (H2) of the two layer wafer 400*a* (FIG. 4), and the depth of the only layer 405*b* of the single-layer wafer 400*b*, determines the depth of the cavity, i.e., (H2−H1)/2 (divided by 2 because each wafer provides only half of the cavity—it is not until the two wafers 400*a* and 400*b* are stacked that a full cavity has been created).

Figure 5:
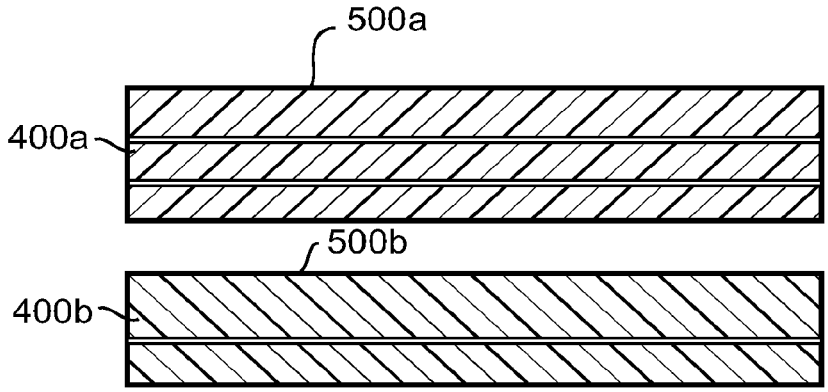
Figure 6:
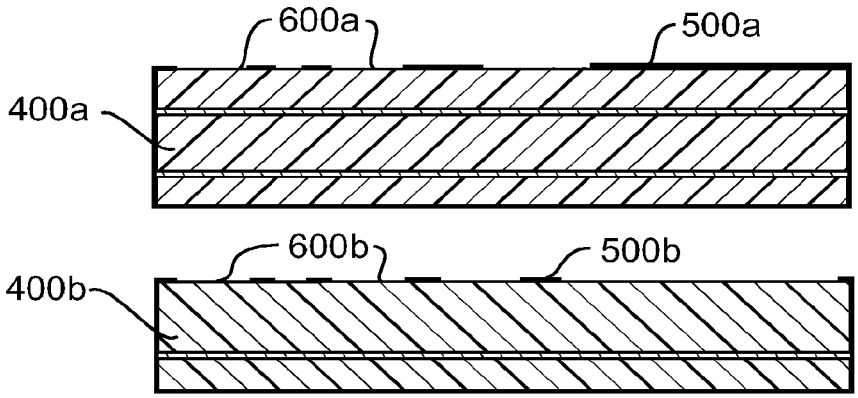

With reference to FIG. 5, a Low Pressure Chemical Vapor Deposition (LPCVD) layer of Silicon Nitride ($S_{i3N4}$) is grown about each of the wafers 400*a*, 400*b*, these layers shown as 500*a* and 500*b*. By controlling gas flow rates, and deposition temperature, these layers 500*a*, 500*b* can be made substantially stress free. Moving to FIG. 6, the $S_{i3N4}$ layers 500*a*, 500*b* are then patterned to create the cavity-half in each wafer, shown as 600*a* on wafer 400*a*, and as 600*b* on wafer 400*b*. Silicon Nitride may be patterned by using a photoresist mask, which is exposed and developed, followed by a $_{H3}P_{O4}$ wet etch, or RIE oxide etch. Following the pattern transfer, the photoresist layer can be stripped using a mild organic solvent.

Figure 7:
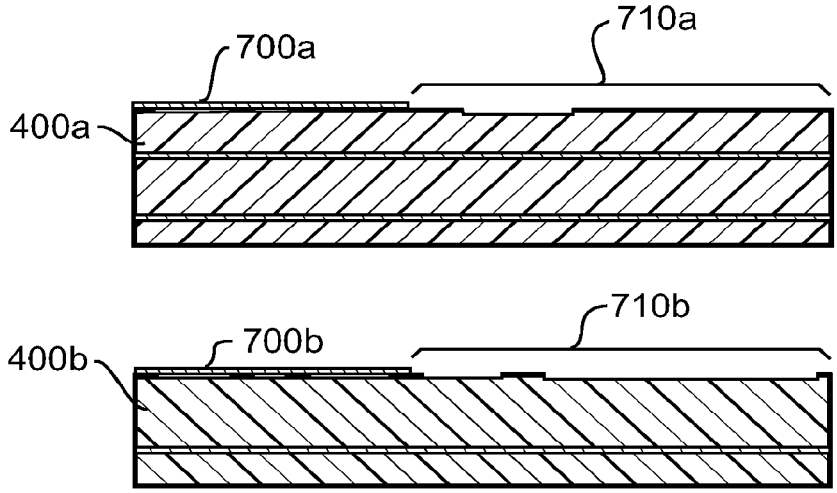
Figure 8:
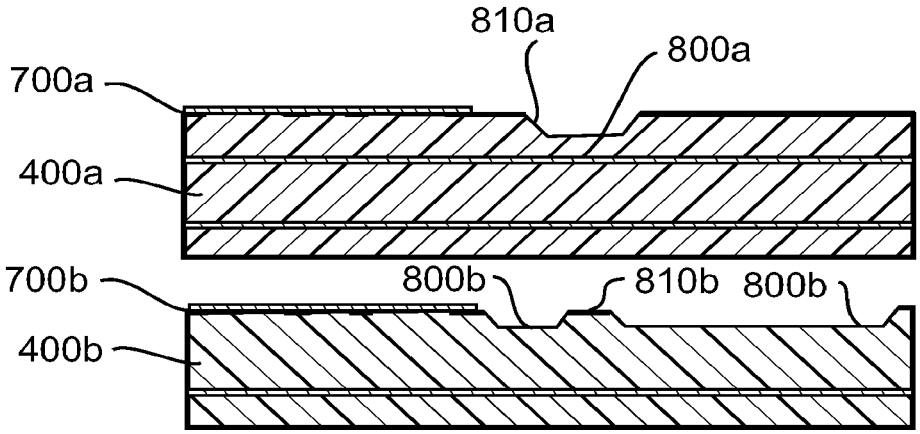

As shown in FIG. 7, a photoresist 700*a* and 700*b* may then be applied to mask the cavity section of each wafer 400*a*, 400*b*, leaving the self-aligning structure zones 710*a* and 710*b* free. Then, as shown in FIG. 8, the etching process for the self-aligning structures may be begun. The exposed silicon layer 800*a*, 800*b* may then be anisotropically etched (shown in FIG. 8) using, e.g., potassium hydroxide (KOH). In the case of wafer 400*a*, the etch can be stopped after a set period of time. For wafer 400*b*, continue until the etch-stop is reached. Note that the etch pattern on wafer 400*a* creates a pit 810*a*, whereas the etch pattern on wafer 400*b* creates a pyramid 810*b*. Also note that it is generally preferred for the mask to be aligned with the <111> crystal planes to achieve appropriate geometry of the pits and pyramids.

Figure 9:
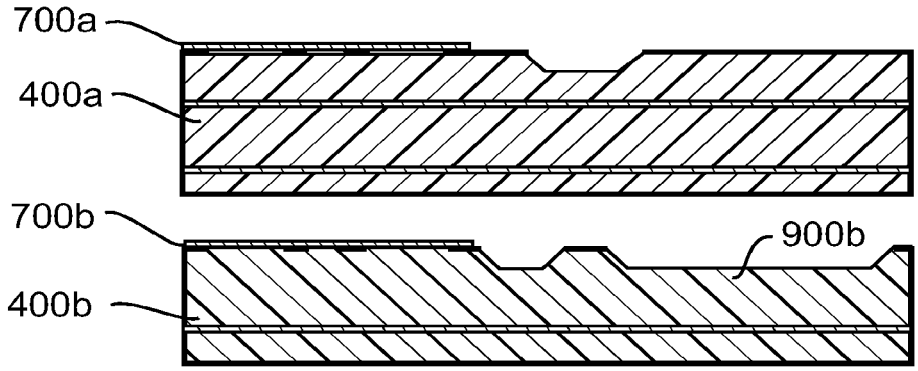
Figure 10:
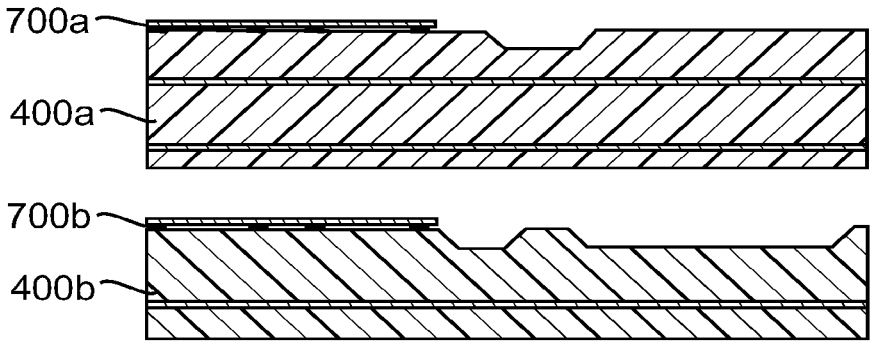
Figure 11:
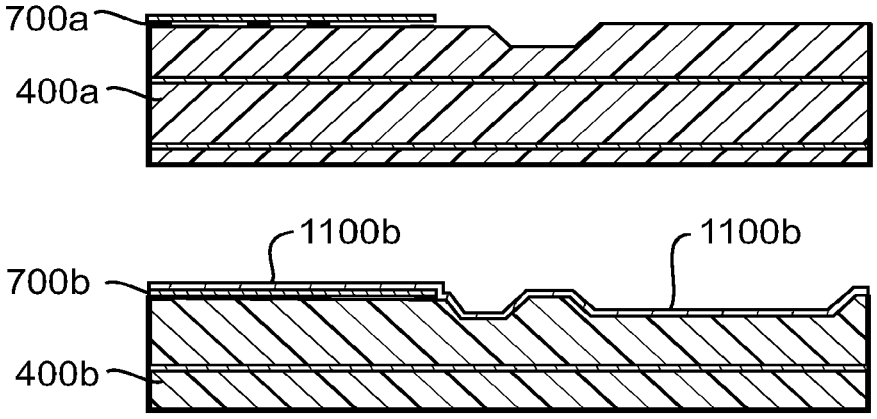
Figure 12:
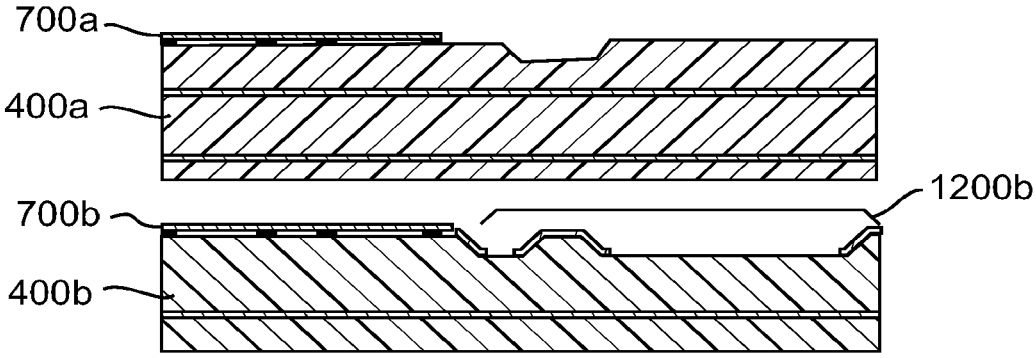

As shown in FIG. 9, the etch-stop layer 900*b* on wafer 400*b* may then removed. This may be done using a wet etchant such as buffered hydrofluoric acid (BHF), or a RIE, with appropriate chemistry. The LPCVD $Si_3N_4$ layers 500*a*, 500*b* may be removed from the exposed areas (as shown in FIG. 10) using, e.g., phosphoric acid ($H_3PO_4$), or RIE with appropriate chemistry.

As shown in FIG. 9, the etch-stop layer 900*b* on wafer 400*b* may then removed. This may be done using a wet etchant such as buffered hydrofluoric acid (BHF), or a RIE, with appropriate chemistry. The LPCVD $Si_3N_4$ layers 500*a*, 500*b* (FIG. 5) may be removed from the exposed areas (as shown in FIG. 10) using, e.g., phosphoric acid ($H_3PO_4$), or RIE with appropriate chemistry.

Figure 13:
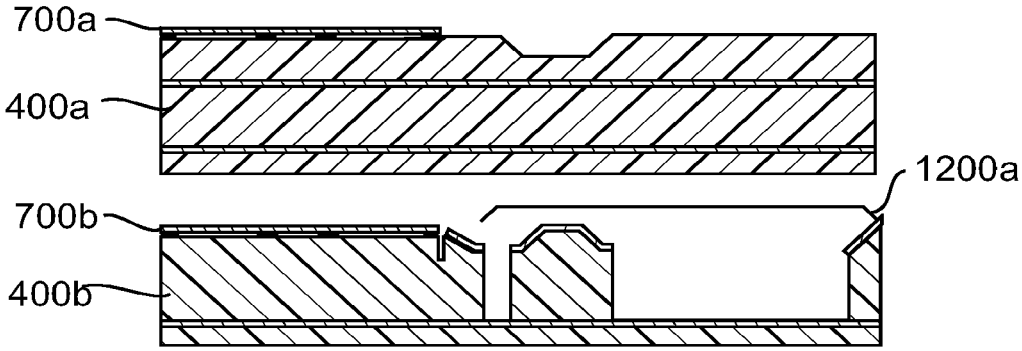
Figure 14:
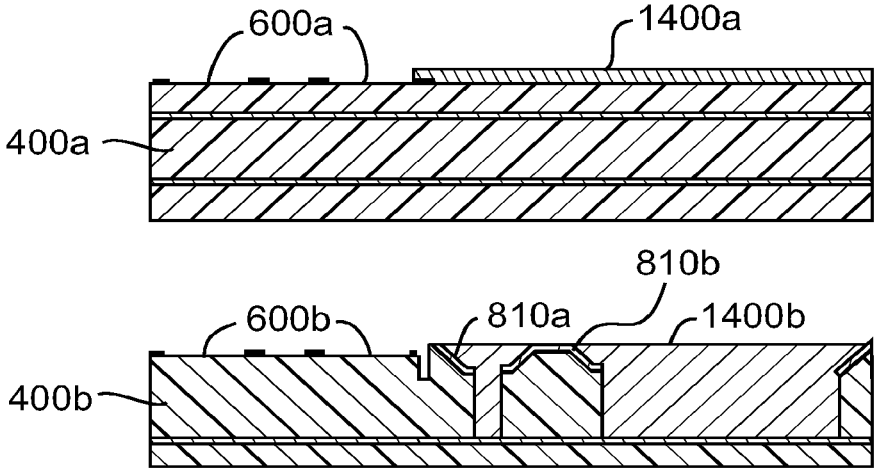
Figure 15:
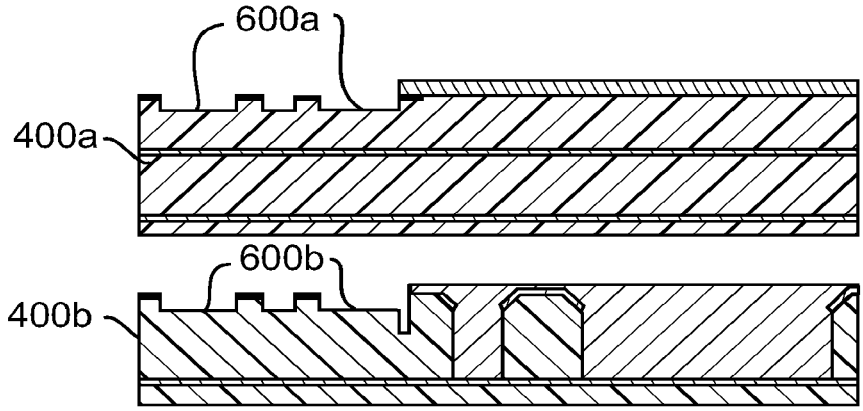

DRIE may then be used to thin the cantilever 1200*b* to a desired thickness, e.g., ~100 μm, as shown in FIG. 13. Again, precision is not critical, so a timed etch can be used to achieve the desired thickness. Moving to FIG. 14, the protective photoresist layer 700*a*, 700*b* may be stripped from the resonant cavity areas of the wafers, 600*a*, 600*b*, and a new layer 1400*a*, 1400*b* may be applied to protect the self-aligning structures 810*b*. Then, the cavity regions 600*a*, 600*b* may be etched using a DRIE etcher (FIG. 15). For wafer 400*b*, this can be completed in a single step, up to the etch-stop layer. In the case of wafer 400*a*, the etch can be run only for a few minutes before the next fabrication step.

Figure 16:
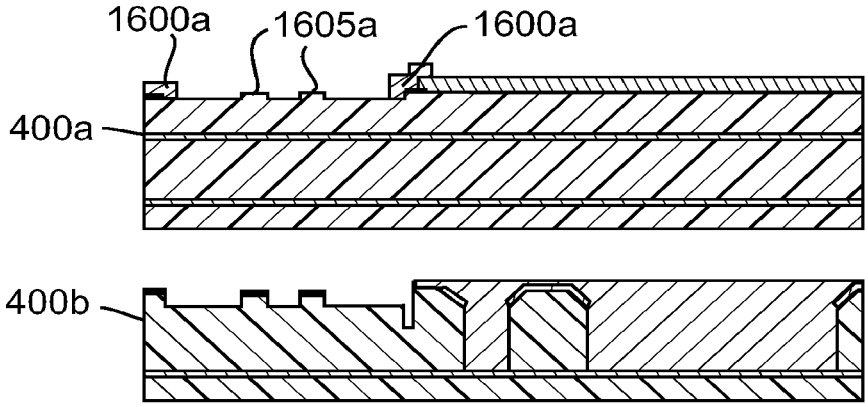
Figure 17:
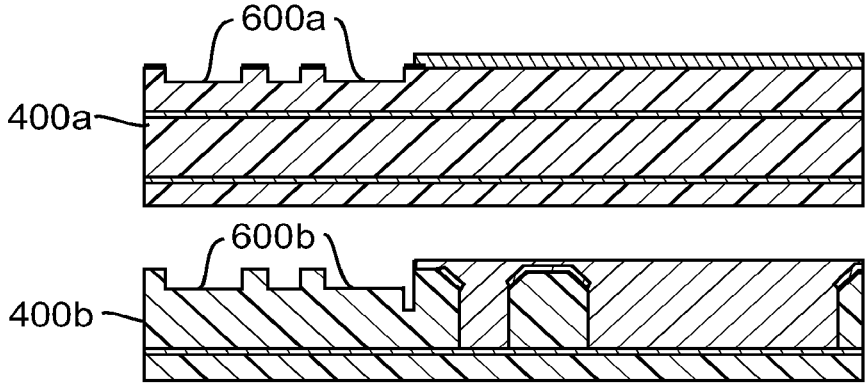

Moving to FIG. 16, the exposed $SiO_2$ on the external edges may be protected using a photoresist layer 1600*a*, and the inner ring 1605*a* removed. This is a direct implementation of a nested etch. Identical etch processes may be conducted with differing start-times, yielding a variation in the ultimate depth. The photoresist layer 1600*a* protecting the outside corners (shown on FIG. 16) may then be removed. FIG. 17 shows the wafers 600*a*, 600*b* following the removal of the photoresist layer.

Figure 18:
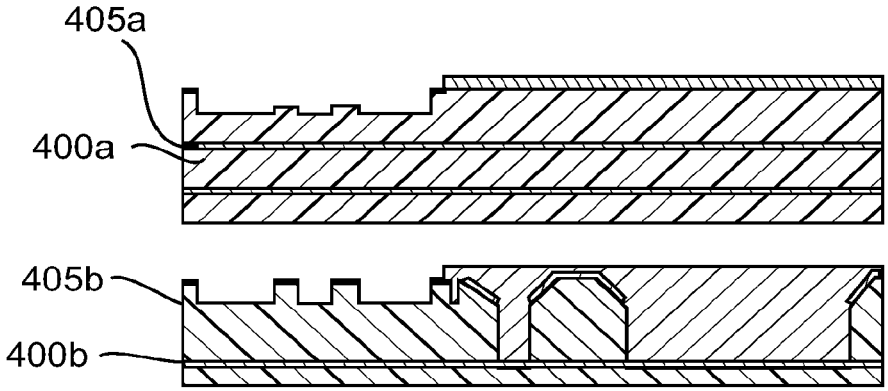
Figure 19:
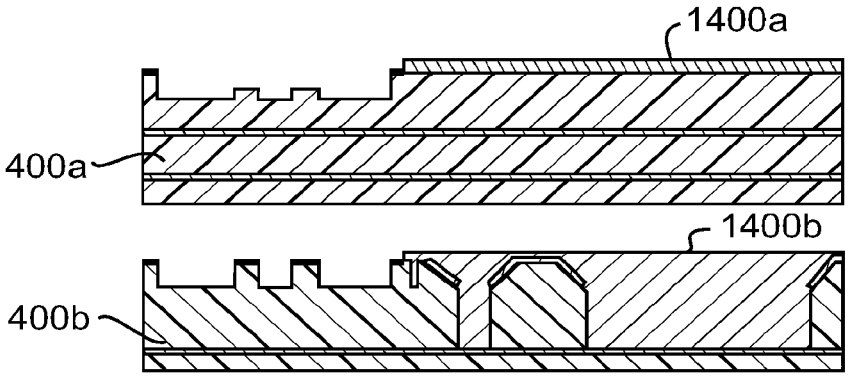
Figure 20:
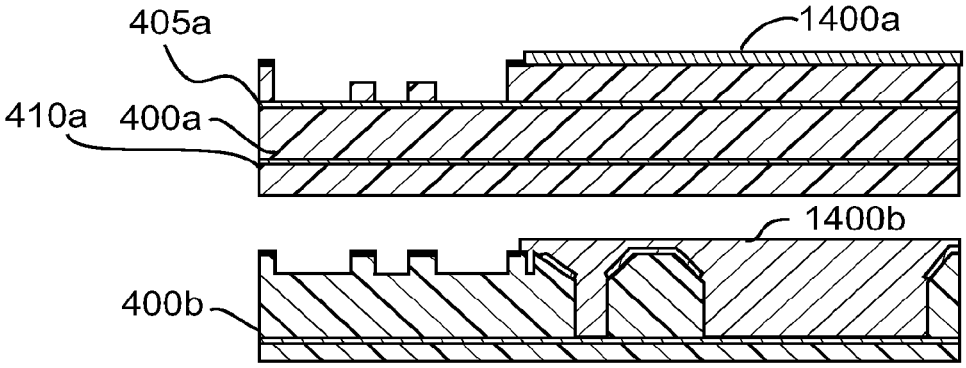

The DRIE etch may be continued until the bottom of the trench arrives at the etch stop layer (FIG. 18). Because of the nested etch, the entire bottom will not be exposed, but only the deepest part of the etched area. The first buried oxide layer 405*a* or single buried oxide layer 405*b* may be removed from the exposed zones, using, e.g., reactive ion etching, or BHF (FIG. 19) and the DRIE etch resumed until both etch-stop layers are encountered (FIG. 20). This gives the etch excellent depth control.

Figure 21:
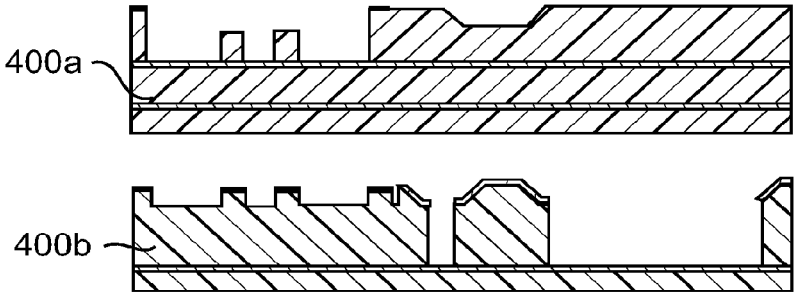
Figure 22:
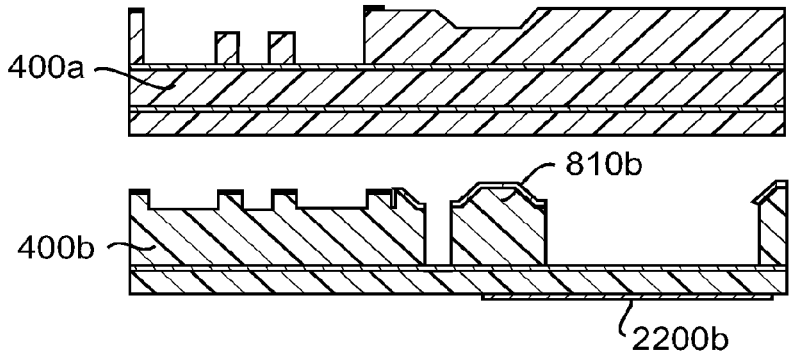
Figure 23:
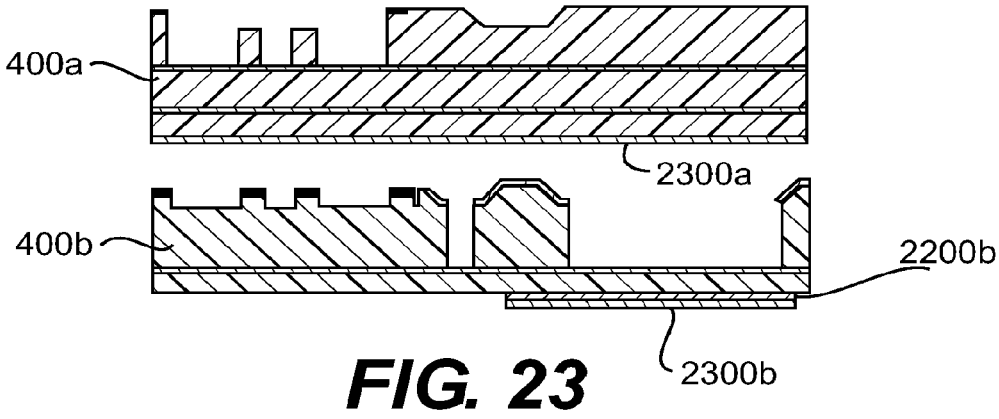
Figure 24:
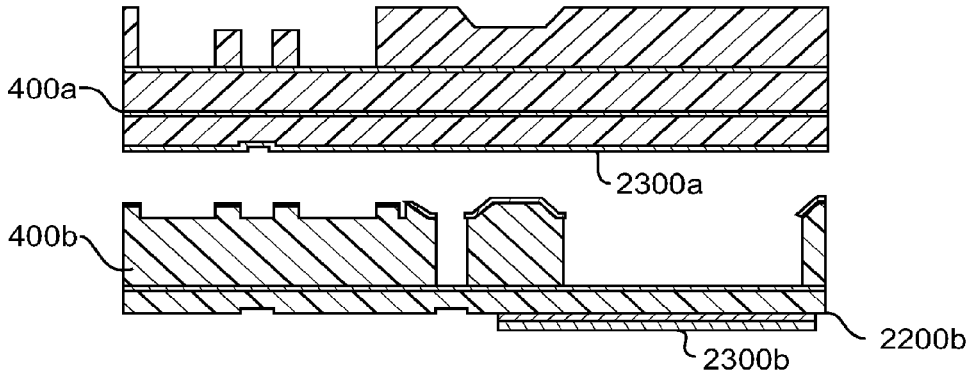

Moving to FIG. 21, the photoresist layer 1400*b* (FIG. 20) may then be removed from the front side of the wafer 400*b*, and a Plasma-Enhanced Chemical Vapor Deposition (PECVD) nitride layer 2200*b* grown on the wafer 400*b* backside (FIG. 22). The intrinsic stress will flex the self-aligning structure 810*b* when released. A layer of CVD Silicon Dioxide ($SiO_2$) 2300*a*, 2300*b* may then be grown on the wafer backsides (FIG. 23), and a pattern transferred to the $SiO_2$ layer using conventional techniques (FIG. 24).

Figure 25:
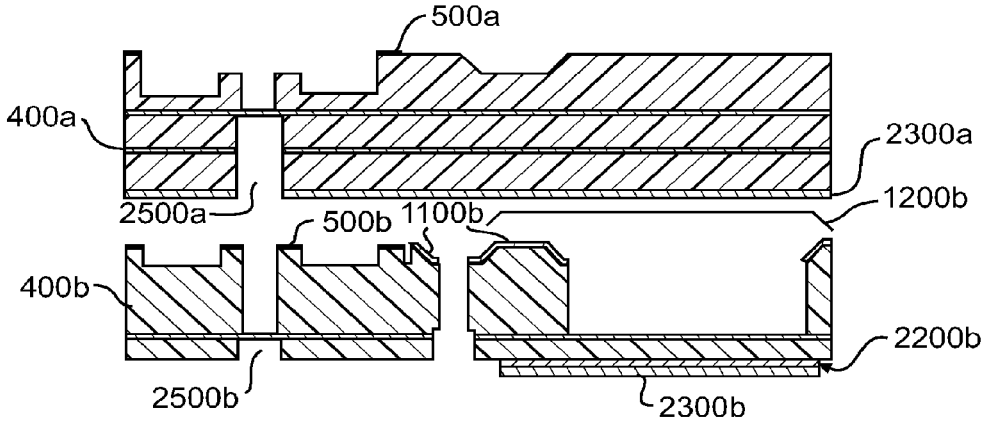
Figure 26:
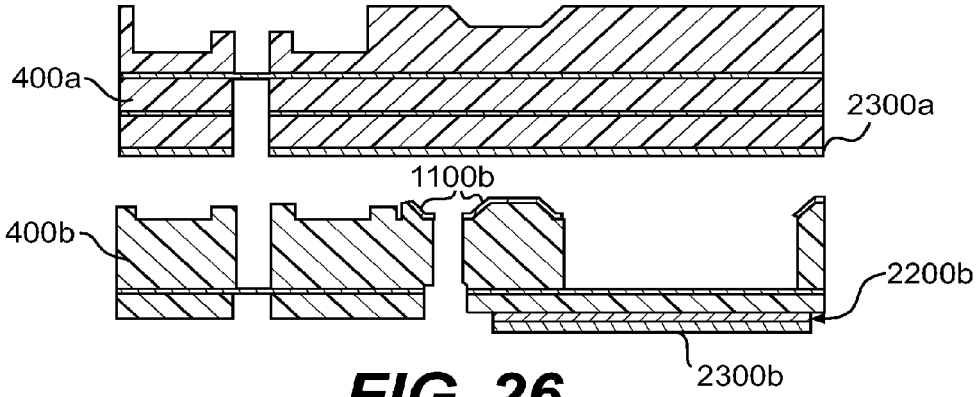
Figure 27:
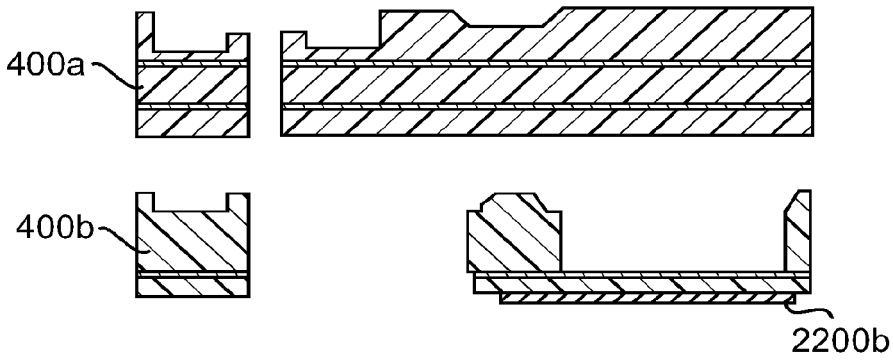

Continuing, the backside of the wafers 400*a*, 400*b* may be etched using DRIE, to free the cantilever 1200*b*, and to create a via for the drift tube 2500*a*, 2500*b* (FIG. 25). The remaining portions of $Si_3N_4$ mask 500*a*, 500*b* (FIG. 25) may be cleaned from the wafers with an appropriate selective etchant, e.g., phosphoric acid ($H_3PO_4$) (FIG. 26). As shown on FIG. 27, a bath of BHF can then be used to remove all remaining $SiO_2$ masking layers 1110*b*, 2300*b* (FIG. 26) from wafer 400*b*.

Then, as shown in FIG. 28, a desired, thin layer of copper 2800*a*, 2800*b* may then be coated on the face of the wafers 400*a*, 400*b*, using, e.g., sputtering exclusively, or electrodeposition following a sputtered seed layer. Any suitable thickness may be deposited, e.g., layer of ~1 μm is generally sufficient for most THz devices. Finally, following CMP, as shown on FIG. 29, the top surfaces of both wafers 400*a*, 400*b* may be placed in contact (e.g, as shown on FIG. 29, wafer 400*a* was rotated 180° so as to fit on top of wafer 400*b*). The self aligning structures, when aligned, should generally interact, bring the wafers 400*a*, 400*b* into excellent alignment.

Thus, in accordance with one embodiment of the invention, this completes the fabrication of an individual cavity, shown as 2900 on FIG. 29, as the combination of the processed wafers 400*a*, 400*b*. Because of the resonant nature of the cavities, their fabrication tolerances are very particular, as recognized by those skilled in the art.

Figure 30:
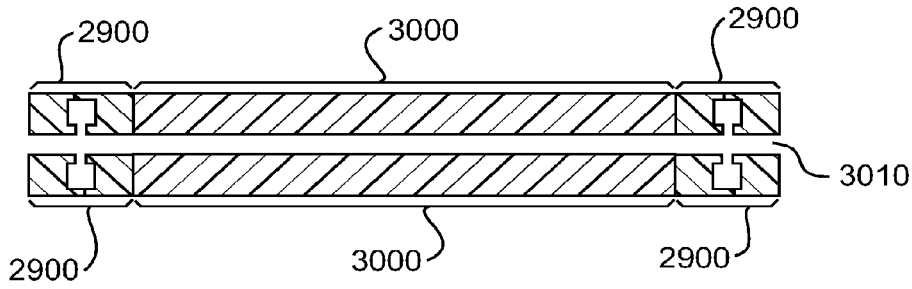
FIG. 30 illustrates an embodiment including resonant cavities of the invention aligned and bonded to a wafer stack having a conductive tube.

When the cavities have been fabricated (e.g., in accordance with the process described with respect to FIGS. 4-29), as shown on FIG. 30, the cavities (e.g., 2900) can be combined with a wafer stack 3000 through which a drift tube 3010 has been bored. The lower required tolerances on the drift tube 3010 within the wafer stack 3000 allow it to be fabricated with traditional through-wafer etches, and wafer bonding. Conventional wafer can be accomplished with ~2 μm alignment, which is sufficient for drift tube alignment.

Through wafer etches can be easily accomplished using DRIE. The drift tube 3010 needs to be conductive, so the component wafer 3000 must also be plated with copper. Alternative methods could also include fabricating the drift tube 3010 directly out of a copper disk, using more conventional machining practices—EDM, laser ablation or electroforming.

Figure 31:
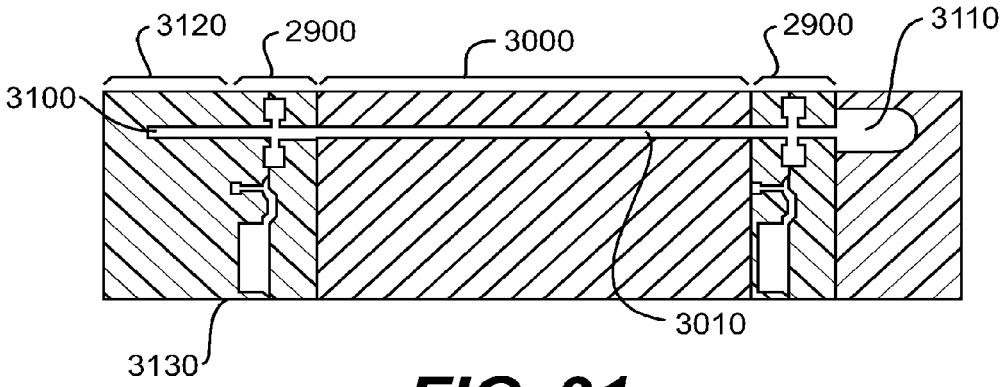
FIG. 31 illustrates an embodiment of a vacuum electron device.

As shown in FIG. 31, the final step for constructing the klystron device according to the present disclosure is to add an electron source 3100, and a sink 3110. The suggested source 3100 is a field emitter array (FEA) capable of producing a very high cathode current density (40 to >100 A/cm$^2$). The advantage of this approach is twofold—it allows for easy assembly and alignment of the beam source 3100 with the drift tube 3010 and cavity stack 2900, and it reduces the complexity of the magnetic field required to contain the beam. To implement an FEA, a wafer 3120 containing an FEA 3100 can be bonded to the wafer stack 2900, along with a dielectric spacer 3130, which allows for the necessary accelerating voltage. Other possible electron sources 3100 include thermionic cathodes, cusp guns, or potentially pseudospark gaps.

EXAMPLES

In accordance with certain embodiments of the invention, exemplary devices were prepared and evaluated.

Example A

See FIGS. 36*a*-36*e*

A THz emitter array Klystron was fabricated, as generally illustrated in FIGS. 36*a*-36*f*. As shown on FIG. 36*a*, each resonant cavity was fabricated to have the following dimensions.

| Dimension | Value |
|---|---|
| H1 | 100 um |
| H2 | 430 um |
| r1 | 35 um |
| r2 | 400 um |
| a | 35 um |

The fabrication methods utilized DRIE etching and wafer-level (or die-level) fusion bonding of silicon wafers to form a negative mold that was coated with sputtered or electrodeposited copper. As shown on FIG. 36*b*, in one embodiment, an 8 kV gun voltage 'stock' FEA 100 with a current density of 40 A/cm2 was fusion-bonded to the base of the tube stack 110 (with a dielectric spacer 3600 between the tube stack 110 and the electron gun 100 having a 1 MV/m field gradient), with the electron beam 105 diameter confined by a 1T magnetic field generated by two permanent magnets 3610 and aligned with the axis of the tube 110. The fabrication process provided excellent alignment of the magnetic field with the tube axis, and allowed for easy integration of the electron gun 100. As shown on FIG. 36*b*, the finished two-cavity klystron (i.e., the two resonant cavities 115, 120 and tube stack 110) measured 1 cm long.

Figure 36A:
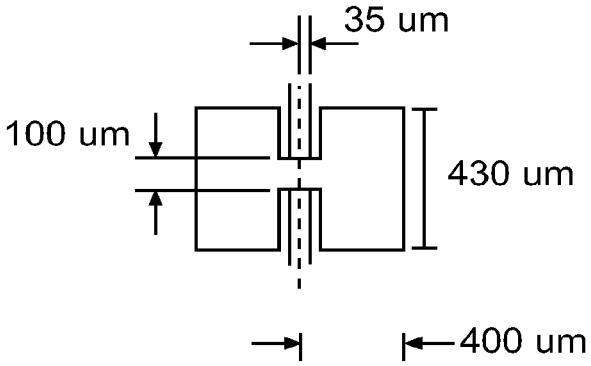
FIGS. 36*a*-36*f* illustrate an exemplary MEMS Klystron.
Figure 36B:
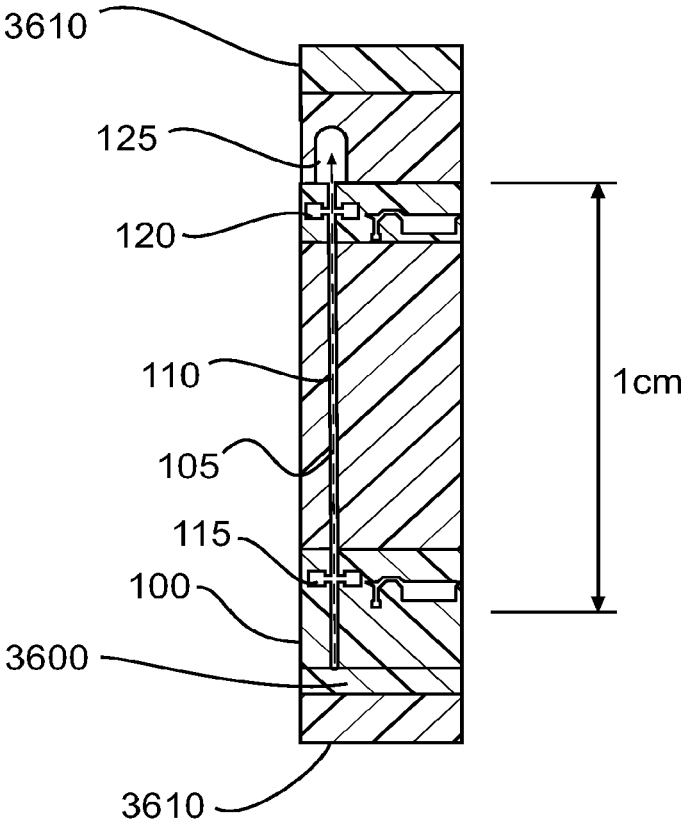
Figure 36C:
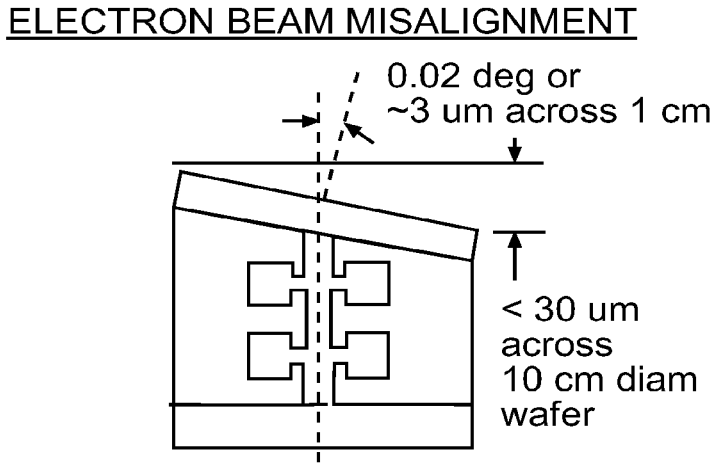
Figure 36D:
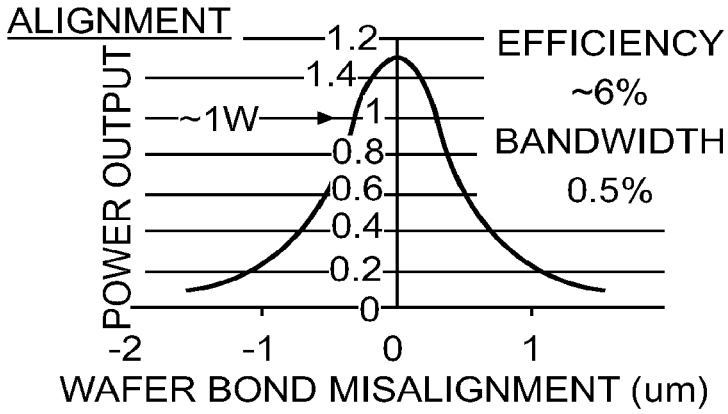

Certain benefits of the fabricated klystron include: better power density and efficiency compared to solid-state or other VED alternatives; continuous-wave THz and/or mm-wave band source; and a three-phase program that will produce a klystron array integrated into a prototype system; and 200 nm bond alignment achieved by the interlocking technique. In addition, the cathode may be scaled to the tube dimensions, and the beam need not be directly aligned with the drift tube; as shown on FIG. 36*c*, the electron beam misalignment may be as much as 0.02 degrees, or ~3 μm across 1 cm, or 30 μm across a 10 cm diameter wafer, though it will be understood that the greatest power output of the klystron occurs when there is minimal misalignment. For example, FIG. 36*d* illustrates how the power output of the klystron may vary with varying degrees of electron beam misalignment. In an exemplary embodiment of the current invention, when the wafers are properly aligned, an efficiency of 6% can be achieved with a bandwidth of 0.5%.

Figure 36E:
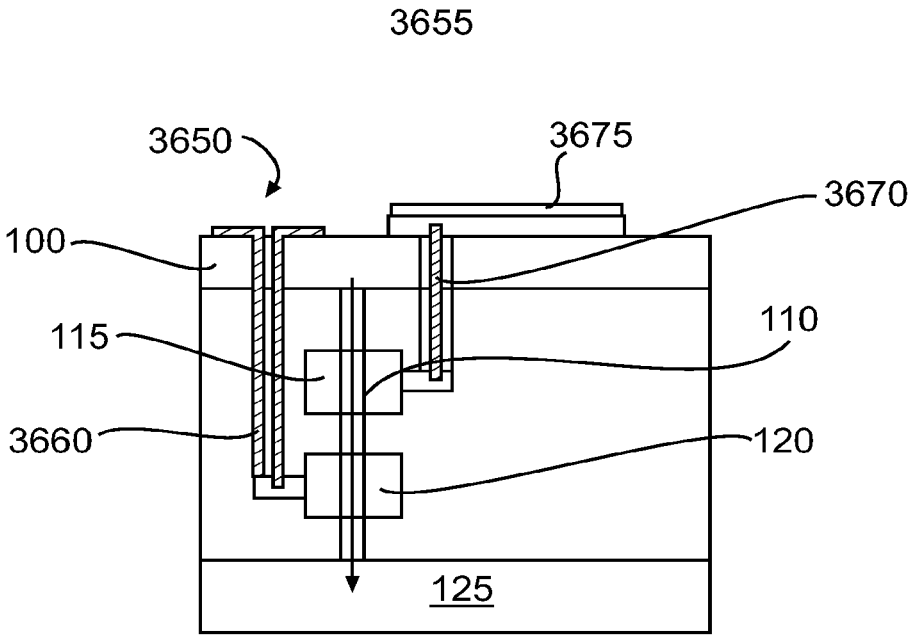
Figure 36F:
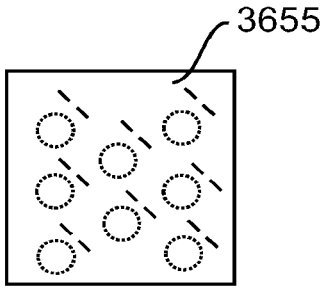
Figure 37A:
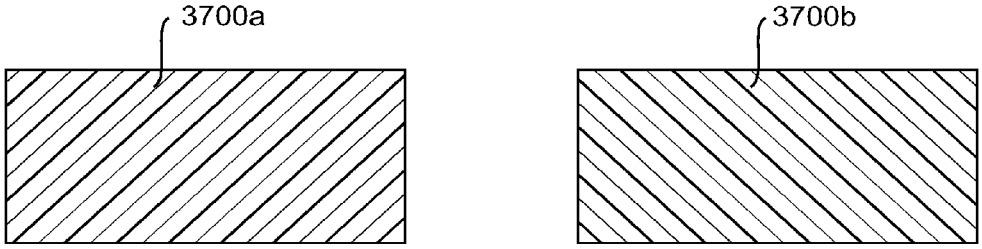
FIGS. 37*a*-37*d* show a simple block diagram of the resonant cavity and drift tube fabrication process.
Figure 37B:
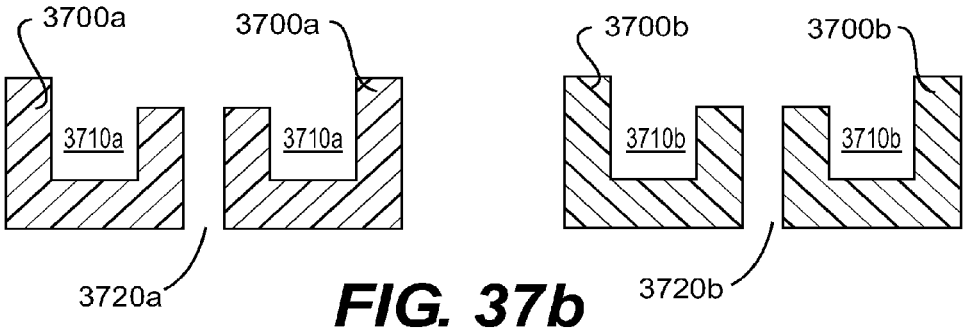
Figure 37C:
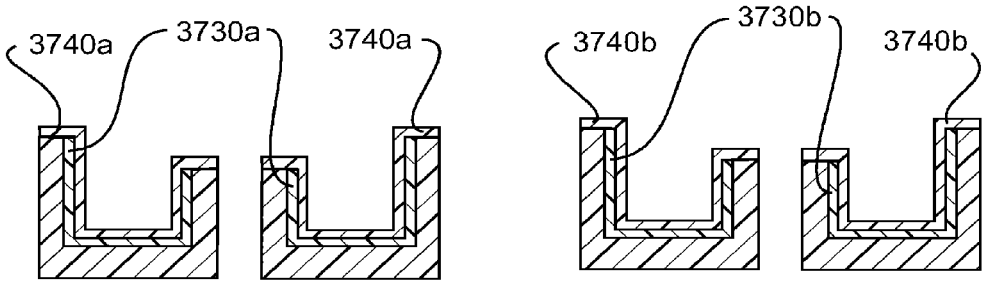
Figure 37D:
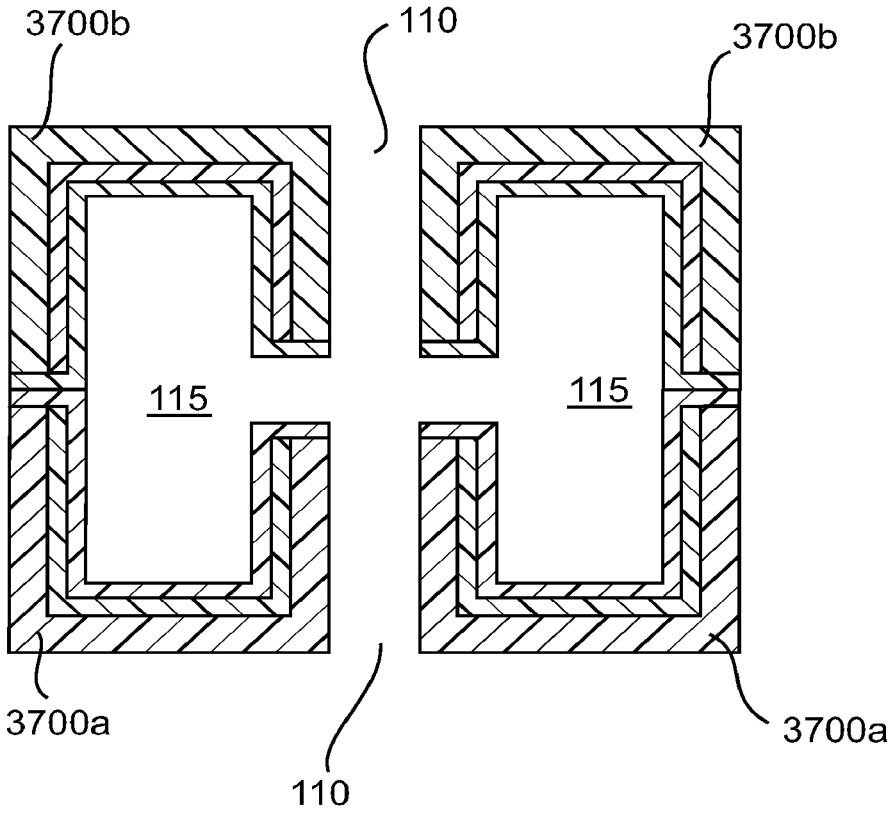

Finally, as shown on FIGS. 36*e*-36*f*, the vertical orientation of the klystron makes it easy to make a high-power phased array. As shown on FIG. 36*e*, an FEA wafer 100 may be placed on top of the klystron (containing input and output cavities 115, 120 and a drift tube 110), which is then placed on top of the collector 125. A dipole 3650 on the surface of the die 3655 may be coupled to the output cavity 120 via a twinlead 3660. The input cavity 115 may be coupled to coaxial line 3670 from a monolithic microwave integrated circuit (MMIC) 3675 and may further be coupled to a stripline from a low power source (not shown). FIG. 36*f* shows a top view of the die 3655 having a high-power phased array. The power density of such a device (limited by ability to cool): is 25 MW/m3.

Efficiency 1% or better

Example B

A 2-cavity klystron was prepared according to fabrication methods of the invention. The beam tunnel diameter for both current, and cavity coupling was optimized while making some reasonable assumptions about current density and filling factor results in a beam tunnel radius of 35 μm, and a beam radius of 25 μm. To obtain such a fine beam with a conventional thermionic cathode would require beam shaving, which would significantly lower the tube efficiency. The alternate approach is to use a FEA, which can produce the necessary current density without beam compression. This also allows for easy integration with a micro-fabricated tube, and simplifies the magnetic field design.

FEAs are capable of producing very high current densities, often exceeding several hundred $A/cm_2$ in ideal conditions. A vacuum tube environment provides less than ideal conditions for an FEA, however it does seem reasonable to expect current densities up to 40 A/cm2. Additionally, FEA performance improves as the size of the array decreases, so they are exceptionally well suited for micro-devices.

The prepared device will use a circular FEA with a 25 μm radius, and a current density of 40 A/cm2, for a total beam current of 0.75 mA. Beam voltage for the device is 2 kV. Higher voltages increase the coupling coefficient, but lower the National Vacuum Electronics Conference 2007, Surrey Ion Beam Centre intrinsic efficiency, as the maximum impedance from a single output cavity is the limiting factor on output power.

Unlike a conventional thermionic cathode, an FEA requires no beam compression, so the magnetic field design does not need to follow a convoluted beam path, or establish a brilloun flow. However an issue that does arise is a very high charge density at the surface of the array. Electrons departing the array have a low kinetic energy, coupled with a high current density implies a very high space charge. Thus the required magnetic field required to prevent a 'blow out' of the beam at the face of the FEA is larger than would be needed to contain a beam of similar current density produced by a conventional cathode.

A pseudospark gap uses a large voltage potential over a small distance to initiate a spark. The ionized gas (plasma) serves as an electron source. By operating on the left-hand side of the paschen curve (i.e., the curve showing the breakdown voltage of gas between parallel plates as a function of pressure and gap distance, represented by the equation $$V = \frac{apd}{(\ln(pd) + b)}$$

where V is the breakdown voltage, p is the pressure, d is the gap distance, and a and b are constants dependent on the composition of the gas), the breakdown is not a real spark, but a pseudo-spark, creating an ion channel that allows exceptionally high current densities (on the order of $kA/cm^2$). A pseudospark uses a hollow cathode and a series of electrodes before the anode, which would make it a good candidate for microfabrication using this technique.

A coaxial magnetic field with a 1T intensity limits the electron deviation to a few microns, which is within the tolerances of the device. Such a magnetic field can be created over small distances, such as a micro-klystron, using strong permanent magnets. Similarly, a solenoid could be employed to produce a similar effect, but reducing the overall device efficiency.

Further developments could implement electron beam containment through a series of periodic permanent magnets (PPM). Fabrication and integration of magents and pole pieces would be integrated into the fabrication of each die—which lends itself very well to this process.

In the case of a pseudospark gap, the high current density combined with the narrow beam spread and high brightness may eliminate the need for a containment field.

The device is evaluated both analytically (this is the primary reason for choosing a 2 cavity klystron) and numerically. Both forms of analysis require a description of the cavities, in terms of impedance, external load, and coupling. Thus the cavities themselves are also evaluated analytically and numerically. An analytic model assuming a simple re-entrant design is considered. The inductive portion of the resonator is modeled as a single turn solenoid, while the capacitive region is approximated by using the Schwarz-Christoffel transformation. A numeric analysis of the cavities is conducted using the finite element code HFSS® 10, by Ansoft.

The cavities have a TM010 mode resonant frequency of 200 GHz, and an unloaded Q of 1070, when formed of copper. Analytic methods suggest a maximum fabrication error sensitivity of 1.3 GHz/μm, while the numeric methods the maximum sensitivity is 0.6 GHz/μm. The Q factor is relatively insensitive to fabrication tolerances.

The cavity design is particularly sensitive to variation in the 'capacitive' portion of the cavity. This sensitivity can be capitalized on by introducing a mechanical actuator in the cavity design, capable of displacing the capacitive gap by a small amount. This would give the cavity an improved non-instantaneous bandwidth, allowing it to operate over a wider frequency range. Mechanical actuation could be realized through direct mechanical deformation, hydraulic pressure, thermal actuation, or piezoelectric actuation.

The micro-klystron is designed as an oscillator. Assuming that 20% of the output power is diverted back to the driving cavity, and estimating a 5 dB waveguide loss, the device shows an output power of 1.3 W, with a gain of 11.7 dB. This corresponds to a device efficiency of 6%. It may also operate as an amplifier, simply by having an external driving the input cavity.

A profile of the spent beam's energy profile shows that a good deal of energy remains in the beam. A more advanced design, involving multiple cavities, and extended interaction regions would improve the device power and possibly bandwidth.

Both numerical and analytical analysis support the potential for DRIE as a means of fabricating a 200 GHz microklystron. The necessary precision in fabrication has been achieved in other fields, as well as techniques such as metalization, and wafer bonding. Thus fabrication of a 200 GHz klystron is possible. Simulation of the proposed device yields an output power of 1.3 W, and a gain of 11.7 dB.

Further evolution of the fabrication technique could be manifested through a series of developments. These include, but are not limited to Multi-beam klystron, Extended interaction klystrons, cavities including variable geometry (see above), and novel electron sources such as the pseudo-spark gap.

While the foregoing advantages of the present invention are manifested in the illustrated embodiments of the invention, a variety of changes can be made to the configuration, design and construction of the invention to achieve those advantages. Hence, reference herein to specific details of the structure and function of the present invention is by way of example only and not by way of limitation.

REFERENCES

[2] Segel, P. "Terahertz Technology", IEEE Transactions on Microwave Theory and Techniques, Vol. 50, No. 3, March, 2002

[3] Mittelman, D. M. et al. "Recent Advances in Terahertz Imaging", Applied Physics B. April 1999

[4] van Exter, Martin, et al. "Terahertz Time Domain Spectroscopy of Water Vapour", Optics Letters, Vol. 14, No. 20. October 1989

[5] Nuss, M. C. "Chemistry is Right for Terahertz" IEEE Circuits and Devices, Vol. 12, Issue 2, March, 1996

[6] Brownell, J. H, Walsh, J. "Spontaneous Smith-Purcell Radiation described through induced surface currents", Physical Review E. Vol. 57, No. 1. January 1998

[7] Gad-el-Hak, M. The MEMS Handbook, CRC Press LLC, 2002

[8] Swartz, J. C. "THz-FIR grating coupled radiation source" Plasma Science IEEE Conference Records June 1998

[9] Scheitrum, G. et al. "Design, fabrication and test of the klystrino" IEEE ICOPS 2002 Conference Record. 2002

[10] Ives, R. L. "Microfabrication of High-Frequency Vacuum Electron Devices" IEEE Transactions on Plasma Science, Vol. 32, No. 3. June 2004

[11] Song, J. J. et al. "LIGA fabrication of mm-wave accelerating cavity structures at the advanced photon source (APS)" IEEE Particle Accelerator Conference Proceedings, May, 1997

[12] Manhara, H. M. "Design and Fabrication of a THz Nanoklystron" Int. Conf. THz Electronics October, 2001

[13] Ives, L. et al. "Development of Terahertz Backward Waver Oscillators" IEEE IVEC 2004 conference proceedings. April 2004

[14] Tucek, J. et al. "Development of a 650 GHz Folded Waveguide Source" IEEE IVEC 2007 proceedings, May 2007*l*

[15] Dayton, J. A. et al. "Fabrication of Diamond-Based 300 and 650 GHz BWOs" IEEE IVEC 2007 proceedings, May 2007

What is claimed is:

1. A terahertz vacuum electronic device comprising:

a drift tube;

at least one set of input resonant cavities and associated input coupling waveguide structures located coaxially with the drift tube;

at least one set of output resonant cavities and associated output coupling waveguide structures located coaxially with the drift tube;

an electron source; and an electron sink/collector;

wherein said vacuum electronic device is configured for operation as a high frequency terahertz device; and wherein at least one of said input resonant cavities and said output resonant cavities are fabricated with less than a 1 μm tolerance in dimensions so as to achieve said terahertz operating frequency.

2. The vacuum electronic device of claim 1, wherein said device is a klystron.

3. The vacuum electronic device of claim 1, wherein the electron source is a field emitter array (FEA) or pseudo-spark gap.

4. The vacuum electronic device of claim 1, wherein at least one of said input resonant cavities or said output resonant cavities are substantially cylindrical in shape and comprise a narrow, capacitive center section and a wide, inductive outer section.

5. The vacuum electronic device of claim 1, wherein at least one of said input resonant cavities or said output resonant cavities are substantially cylindrical in shape and have a maximum diameter of 400 μm, with less than 1 μm tolerance.

* * * * *

UNITED STATES PATENT AND TRADEMARK OFFICE

CERTIFICATE OF CORRECTION

PATENT NO. : 8,441,191 B2
APPLICATION NO. : 12/258107
DATED : May 14, 2013
INVENTOR(S) : Jonathan Michael Protz et al.

It is certified that error appears in the above-identified patent and that said Letters Patent is hereby corrected as shown below:

In the Specification

At column 6, line 27, after the word "voltage", "Vg" should read as --$V_O$--;

At column 9, line 28, after the word "FIGS.", the numbers "38a-32e" should read as --32a-32e--;

At column 10, line 64, after the word "Nitride", "($S_{i3N4}$)" should read as --($Si_3N_4$)--;

At column 11, line 1, after the word "the", "$S_{i3N4}$" should read as --$Si_3N_4$--;

At column 11, line 5, after the word "a", "$_{H3}{}^{P}{}_{O4}$" should read as --$H_3PO_4$--;

At column 11, line 30, after the word "then", add the word --be--; and

At column 16, line 44, after the number "2700", delete the "/".

Signed and Sealed this
Sixth Day of August, 2013

Teresa Stanek Rea
*Acting Director of the United States Patent and Trademark Office*